US010027074B2

(12) United States Patent
Gibson et al.

(10) Patent No.: US 10,027,074 B2
(45) Date of Patent: Jul. 17, 2018

(54) MOVING PART COAXIAL CONNECTORS

(71) Applicant: Holland Electronics LLC, Ventura, CA (US)

(72) Inventors: Reed Gibson, Ventura, CA (US); George Goebel, Ventura, CA (US); Michael Holland, Ventura, CA (US); Jason Holt, Ventura, CA (US)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 15/482,727

(22) Filed: Apr. 8, 2017

(65) Prior Publication Data

US 2017/0214192 A1 Jul. 27, 2017

Related U.S. Application Data

(63) Continuation of application No. 14/488,202, filed on Sep. 16, 2014, now Pat. No. 9,627,814, which is a continuation-in-part of application No. 13/913,487, filed on Jun. 9, 2013, now Pat. No. 9,136,629, which is a continuation-in-part of application No. 13/911,032, filed on Jun. 5, 2013, now Pat. No. 9,130,288.

(60) Provisional application No. 61/717,595, filed on Oct. 23, 2012, provisional application No. 61/673,356, filed on Jul. 19, 2012.

(51) Int. Cl.

| | |
|---|---|
| ***H01R 9/05*** | (2006.01) |
| ***H01R 24/40*** | (2011.01) |
| ***H01R 13/40*** | (2006.01) |
| ***H01R 13/6582*** | (2011.01) |
| *H01R 103/00* | (2006.01) |

(52) U.S. Cl.

CPC ..... *H01R 24/40* (2013.01); *H01R 13/40* (2013.01); *H01R 13/6582* (2013.01); *H01R 2103/00* (2013.01)

(58) Field of Classification Search

CPC .. H01R 24/40; H01R 13/6582; H01R 13/512; H01R 13/0524; H01R 13/633; H01R 13/40; H01R 2103/00; H01R 24/46

USPC ..... 439/578

See application file for complete search history.

(56) References Cited

U.S. PATENT DOCUMENTS

| | | | | |
|---|---|---|---|---|
| 4,275,946 A | | 6/1981 | Manina et al. | |
| 4,633,048 A | | 12/1986 | Komatsu | |
| 4,660,921 A | | 4/1987 | Hauver | |
| 5,175,493 A | | 12/1992 | Langgard | |
| 5,329,262 A | * | 7/1994 | Fisher, Jr. | H01R 13/6315 333/260 |
| 5,516,303 A | * | 5/1996 | Yohn | H01R 13/6315 439/248 |

(Continued)

FOREIGN PATENT DOCUMENTS

| | | |
|---|---|---|
| EP | 1895625 A1 | 3/2008 |
| GB | 2314465 A | 12/1997 |

*Primary Examiner* — Jean F Duverne

(74) *Attorney, Agent, or Firm* — Paul D. Chanellor; Ocean Law

(57) ABSTRACT

A coaxial connector includes a body having a longitudinal axis passing through first and second opposed body ends, the second body end for engaging a male coaxial connector, within the body a coil spring, a connector center conductor, and a second body end insulator supporting the connector center conductor, and a spring for urging an electromagnetic shield to protrude from the body.

13 Claims, 37 Drawing Sheets

(56) References Cited

U.S. PATENT DOCUMENTS 5,598,132 A 1/1997 Stabile
5,632,637 A 5/1997 Diener
5,746,619 A * 5/1998 Harting ..... H01R 24/40 439/352
5,820,390 A 10/1998 Takamoto et al.
5,921,793 A 7/1999 Phillips
6,019,622 A 2/2000 Takahashi et al.
6,113,431 A * 9/2000 Wong ..... H01R 9/0521 439/638
6,270,367 B1 8/2001 Bussard
6,276,970 B1 * 8/2001 Wong ..... H01R 24/542 439/578
6,329,251 B1 12/2001 Wu
6,712,631 B1 3/2004 Youtsey
6,716,062 B1 4/2004 Palinkas et al.
7,442,084 B2 10/2008 Montena
7,753,705 B2 7/2010 Montena
7,934,954 B1 5/2011 Chawgo et al.
7,938,680 B1 5/2011 Hsieh
8,272,893 B2 9/2012 Burris et al.
8,556,656 B2 10/2013 Thomas et al.
8,602,818 B1 12/2013 Chawgo et al.
8,690,603 B2 4/2014 Bence et al.
8,708,737 B2 4/2014 Chawgo et al.
8,753,147 B2 6/2014 Montena
8,758,050 B2 6/2014 Montena
8,888,527 B2 * 11/2014 Chastain ..... H01R 24/542 439/578
9,130,288 B2 9/2015 Holland
9,136,629 B2 9/2015 Holland
9,178,317 B2 11/2015 Holland
9,407,050 B2 * 8/2016 Holland ..... H01R 24/46
2003/0129873 A1 * 7/2003 Heebe ..... H01R 13/633 439/578
2005/0148236 A1 7/2005 Montena
2007/0298653 A1 12/2007 Mahoney et al.
2009/0011628 A1 1/2009 Purchon
2009/0053929 A1 * 2/2009 Burris ..... H01R 9/05 439/578
2009/0114424 A1 5/2009 Holland
2009/0203257 A1 * 8/2009 Clyatt ..... H01R 9/0515 439/585
2010/0015849 A1 * 1/2010 Lee ..... H01R 9/0515 439/578
2010/0255721 A1 10/2010 Purdy et al.
2011/0045694 A1 * 2/2011 Chee ..... H01R 24/542 439/578
2011/0076885 A1 * 3/2011 Shaw ..... H01R 13/111 439/582
2011/0117776 A1 5/2011 Burris et al.
2011/0244720 A1 * 10/2011 Peng ..... H01R 24/44 439/578
2013/0084741 A1 4/2013 Pabst et al.
2013/0102190 A1 * 4/2013 Chastain ..... H01R 24/542 439/583
2013/0137300 A1 * 5/2013 Eriksen ..... H01R 9/0524 439/583
2013/0171870 A1 * 7/2013 Chastain ..... H01R 13/512 439/583
2013/0266275 A1 10/2013 Holland

* cited by examiner

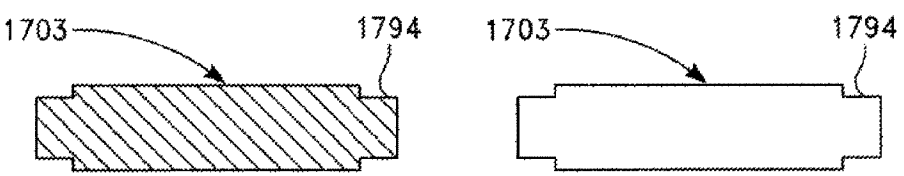
FIG. 17A
FIG. 17B
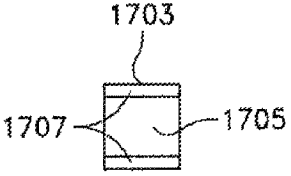
FIG. 17C
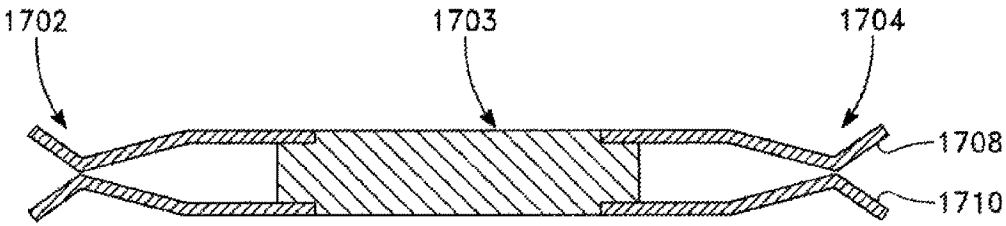
FIG. 17D
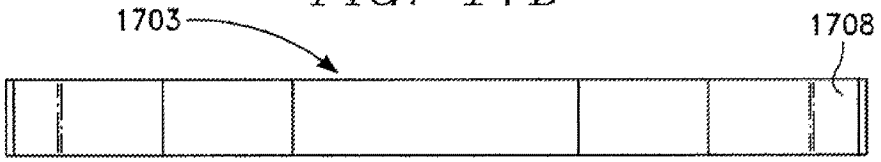
FIG. 17E
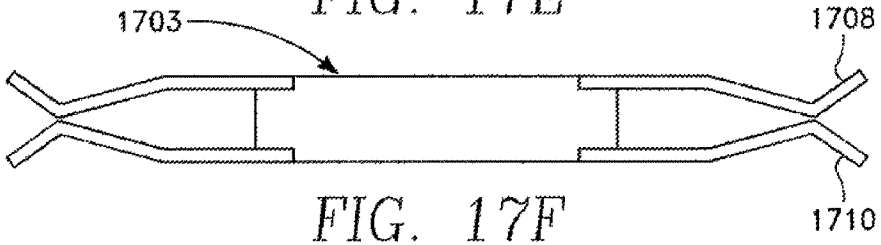
FIG. 17F
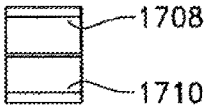
FIG. 17G

MOVING PART COAXIAL CONNECTORS

PRIORITY CLAIM AND INCORPORATION BY REFERENCE

This application is a continuation of U.S. patent application Ser. No. 14/488,202 filed Sep. 16, 2004 and entitled MOVING PART COAXIAL CONNECTORS which is a continuation-in-part of U.S. patent application Ser. No. 13/913,487 filed Jun. 9, 2013 and entitled MOVING PART COAXIAL CABLE CONNECTORS which claims the benefit of U.S. Prov. Pat. App. Nos. 61/717,595 filed Oct. 23, 2012 and 61/673,356 filed Jul. 19, 2012. This application is a continuation-in-part of U.S. patent application Ser. No. 14/069,221 filed Oct. 31, 2013 which is a continuation-in-part of U.S. patent application Ser. No. 13/712,828 filed Dec. 12, 2012, which claims the benefit of U.S. Prov. Pat. App. No. 61/620,355 filed Apr. 4, 2012. All of these applications are incorporated herein by reference, in their entireties and for all purposes.

BACKGROUND OF THE INVENTION

Field of the Invention

The invention relates to articles of manufacture. In particular, a coaxial cable connector includes a moving nose urged from an opening near an end of the connector.

Discussion of the Related Art

In cable television and satellite television systems ("CATV"), signal management includes maintaining circuit continuity and reducing unwanted radio frequency ("RF") signals exchanged at coaxial cable connectors. Among other things, signal management works to improve signal transmission, to improve signal to noise ratio, and to avoid distortion associated with saturated reverse amplifiers and related optic transmission equipment.

Past efforts to limit interfering RF signals into CATV systems have been reported, including the efforts of this inventor. Solutions have included increased use of traditional connector shielding, multi-braid coaxial cables, connection tightening guidelines, increased use of traditional splitter case shielding, and high pass filters limiting low frequency spectrum signal ingress and interference with active home CATV systems.

While it appears the industry accepts the status quo as satisfactory, there remain, in the inventor's view, good reasons to develop improvements that further improve the shielding of coaxial connectors including coaxial cable connectors and in particular female coaxial connectors.

CATV industry experience shows that all of poor signal transport through mated connectors, stray signal ingress into mated or open connectors, and signal emission from mated or open connectors represent potential problems.

Stray RF signals can cause problems in CATV systems such as home CATV systems. For example, when a subscriber leaves a CATV connection such as a wall-mounted connector or coaxial cable drop connector disconnected/open, an unprotected stray signal ingress point is created. The open connector end exposes a normally metallically enclosed and shielded signal conductor and can be a significant source of unwanted RF ingress alone, or in the aggregate with other signal ingress locations.

Coaxial connectors are commonly used in residences and in coaxial cable signal distribution systems for, inter alia, interconnecting cable and satellite television equipment in the home. Wall mounted female coaxial connectors and/or coaxial cable "drop(s)" including a male coaxial connector commonly supply a signal to the TV set, cable set-top box, or internet modem. Notably, wall mounted female coaxial connectors are commonly connected via a coaxial cable terminated with male connectors at opposite ends.

Whether a CATV signal is supplied to equipment via a drop cable or via a wall mounted connector, this connection is a potential source of unwanted RF signal ingress. Wall mounted connectors left open or coaxial cables attached to the wall mounted connector but otherwise open are points of unwanted RF signal transfers. Similarly, drop cables such as those terminated with a male F connector become unwanted RF signal transfer points when left open.

Multiple CATV connections in a home increase the likelihood that some connections will be left open and/or unprotected, making them, for example, a potential source of unwanted RF ingress. And, when subscribers move out of a home, CATV connections are typically left open, another situation that creates undesirable RF signal transfer points with the CATV distribution system.

A known method capable of eliminating unwanted RF ingress in a CATV system involves the use of metal covers on unused coaxial connectors in the home or, to place a metal cover over the feeder coaxial connection at the home network box. But, in the usual case home CATV connections are left active and open, an undesirable but accepted practice the industry tolerates to avoid expensive service calls associated with new tenants and/or providing the CATV signal in additional rooms.

The inventor's experience shows current solutions for reducing unwanted RF ingress resulting from open connectors are not successful and/or are not widely used. Therefore, to the extent the CATV industry recognizes a need to further limit interfering RF ingress into CATV systems, it is desirable to have connectors that reduce unwanted RF signal transfers when connections coupled to the CATV system are left open.

Points of unwanted RF signal transfer are created by loosely mated connectors. In particular, loose connectors typically have gaps in the electromagnetic containment intended to enclose signal conductors and to prevent unwanted signal ingress. These gaps also interrupt ground path circuits. Here, ingressing signals travel in gaps between connector parts such as a gap between the nut and mandrel flange resulting from a loose fitting nut. Notably, in some recent male coaxial connectors this problem is resolved or mitigated using a supplemental spring contact to either electrically interconnect open electrical contacts or provide an axial spring force to push the nut against the connector mandrel flange. (See, for example, U.S. Pat. Nos. 6,712,631, 6,716,062, and 7,753,705.) Some others utilize a spring located behind the male connector nut. One solution (i.e. U.S. Pat. No. 6,712,631) uses a split washer as a spring to mitigate the problem.

Notably, while the signal ingress problem has received some attention in the cable television industry, prior art solutions have relied on modifications made to the male coaxial connector, not modifications made to the female coaxial connector.

Further, known solutions do not mitigate the problem of undesirable RF signal transfers via loose nut threads.

Known signal ingress solutions also do not generally teach the solutions disclosed herein including waveguides and/or urging 360 degree contact between a nut rim and mandrel flange to create an RF barrier. For example, references using moving parts were designed and used for purposes other than meeting the RF shielding needs of present-day CATV service providers.

Some references fix the connector center conductor to an activation mechanism. For example, U.S. Pat. Nos. 4,660,921 and 5,598,132 use a moving center pin attached a moving insulator. Among other things, this design is not applicable to device mounted connectors and is unreliable because of uncertain contact with a center conductor. Notably, installers hand-craft coaxial cable center conductor lengths and, where too short, these lengths fail to contact the moving center pin.

U.S. Pat. No. 6,270,367 requires a center conductor coiled into a spring and acting as a series inductor. As skilled artisans will appreciate, such structures are generally ill suited to high frequency operations including frequencies over 20 MHz, a limitation far short of present day 100 megahertz and gigahertz requirements.

U.S. Pat. No. 6,329,251 discloses the center conductor of the connector as an operational component in transferring forces. Such a design compromises the connector conductive center pin and compromises RF performance due to the larger size center pin required.

U.S. Pat. No. 7,938,680 (the "'680" patent) includes a continuity spring forward of the front ferrule face with its contact point facing radially inward against the female body but enclosed in a tube extended from the forward part of the ferrule post. In the '680 patent, the approach to resolving the electrical continuity problem while avoiding the disadvantage of other spring loaded designs is to extend a sleeve attached to the post forward end where an inward connection spring is located. This would electrically connect the spring to the tube via contact with the outer sleeve. But, this approach also has disadvantages. For example, there is a need for an expensive, very large outer nut to contain the new internal sleeve. In addition, the F connector tightening tools and industry specifications generally require a standard hex nut with an 11 mm hex-hex dimension, requirements that are not possible with this inner sleeve design.

Each of U.S. Pat. Nos. 7,938,680, 6,712,631, 6,716,062, 7,753,705, 4,660,921, 5,598,132, 6,270,367, and 6,329,251 is incorporated herein by reference in its entirety and for all purposes.

The interface between male and female coaxial connectors requires good contact of the outer shield in order to both transport the RF signals with integrity and to prevent unwanted signal ingress. These goals are served in a variety of ways with RF coaxial connectors. One method uses threaded male female interfaces and precise tightening specifications to set torque levels insuring proper operation. Industry experience shows maintenance of required RF performance using this method requires both a high level of installation craft skill as well as suitable environmental conditions such as environments free of vibration and excessive temperature changes. But, coaxial connectors such as CATV connectors are used in consumer applications where there is no assurance the user will follow difficult or even any particular installation specifications. Therefore a need exists for coaxial connectors that insure proper electrical continuity despite a loosened male connector nut and that provide shielding when the connector is unmated.

Male coaxial type coaxial connectors may use a fastener such as a nut or sleeve to secure the male connector with a female connector having a mating securement means. In various examples, tightly mated connectors maintain a good connection from the coaxial cable outer ground/shield and a male connector ferrule tube/post to the female connector outer body. But, if the male connector is not fully engaged with the female connector, the ground connection between the cable and a connected device/cable may be faulty. Known methods to remedy loose connectors may use a spring behind a male connector mandrel flange to spring the flange against a female connector end-face. Solutions of this sort suffer a disadvantage when the cable is off-axis. In particular, when a fastener is loose, interface planes that should be parallel are not, resulting in compromised electrical conductivity.

SUMMARY OF THE INVENTION

In various embodiments, the present invention provides a coaxial connector.

In an embodiment, a coaxial connector comprises a connector body having a longitudinal axis passing through first and second opposed body ends, the second body end for engaging a male coaxial cable connector. Within the connector body is a coil spring extending along the longitudinal axis, a connector center conductor, and a second body end insulator supporting the connector center conductor. The spring encircles the second body end insulator. A spring stationary end is proximate an insulator and a spring moveable end is for urging an electromagnetic shield to protrude from an aperture in the second end of the connector body. The spring is compressed when the male coaxial cable connector engages the electromagnetic shield and the connector body second end.

Some embodiments include a resilient ground wiper for electrically interconnecting the electromagnetic shield and the connector body and the ground wiper extends between opposed surfaces of the electromagnetic shield and the body. And, in some embodiments the second body end insulator and a second body end insulator are stationary insulators. In some embodiments, the connector body contains but one coil spring extending along the longitudinal axis.

In some embodiments the second body end insulator is a stationary insulator having a proximal end bearing on the connector body and a distal end adjacent to the aperture. And, in some embodiments the spring stationary end bears on an electrically conductive ring that in turn bears on the second body end insulator proximal end, the ring for completing an electrical ground path between the spring and the connector body.

There are embodiments comprising a gap between the electromagnetic shield and the second body end insulator such that the shield and a second insulator are not in physical contact. And, in some embodiments the first body end is for engaging a coaxial connector.

Waveguide embodiments provide a waveguide such as a waveguide with a central aperture having a maximum dimension of 3.0 mm. Some embodiments provide a waveguide aperture thickness with a maximum dimension of 2.0 mm.

Connector center conductors that are non-tubular are disclosed. In various embodiments, an end of the connector center conductor supported by the second body end insulator includes jaws and a center conductor link portion that extends from the jaws. Several embodiments provide one or more of: a cross-section of the link normal to a connector longitudinal axis is an open cross-section; a link cross-section described by three sides of a rectangle; a link cross-section described by an arc; a link cross-section described by an incomplete triangle; a first cross-section of the link normal to connector longitudinal axis that is a solid cross-section; a solid link cross-section described by a circle; and, a second solid link cross-section described by a circle with diameter different from that of the first cross-section.

Other non-tubular connector center conductors disclosed include various embodiments where: the link is formed as a planar element; the link is formed by plural substantially planar elements; the link is formed by folding a planar element to form a link having an open cross-section normal to the connector axis; the jaws are elongated plates bent to form an undulating surface along a length of the jaw.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

FIGS. 9A-22E show multiple different embodiments of coaxial connector center conductors.

DETAILED DESCRIPTION OF THE PREFERRED EMBODIMENT

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

Figure 1:
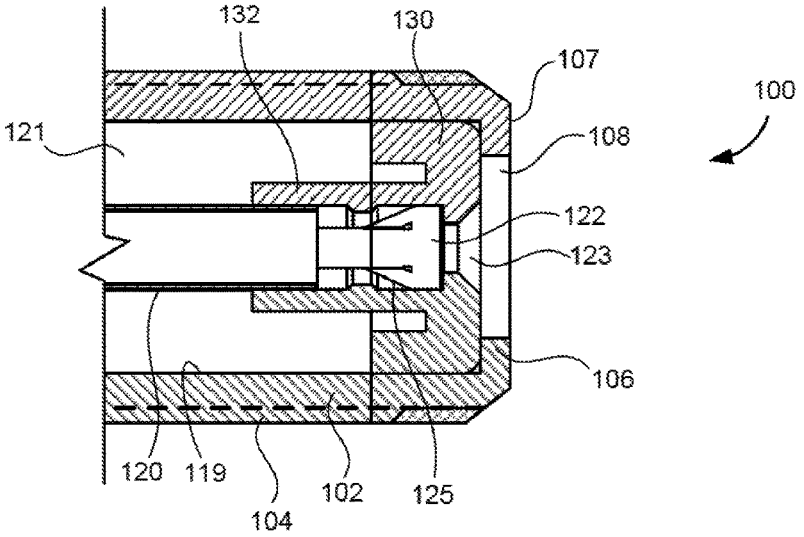
FIG. 1 PRIOR ART
FIG. 1 shows a portion of a prior art female F connector.

FIG. 1 shows a prior art female portion of an F coaxial cable connector ("F connector") 100. This connector portion includes a connector body 102, a conductive pin 120 with a pin mouth 122, and a pin mouth insulator 130 for locating the pin mouth 122 about centrally in a connector body cavity 121

The body cavity 121 has a body inside wall 119 that encircles the insulator 130. In various embodiments the insulator is retained within the cavity by a female end rim 106 that presents a female end-face 107. Body attachment means such as threads encircling the body 104 provide for engaging a male connector (discussed below) with the female connector.

The conductive pin 120 is received by a socket of 132 of the insulator 130 such that the pin mouth 122 is accessible via an insulator mouth 123 near the body mouth 108. In an embodiment the pin mouth is integral with the conductive pin and in an embodiment the pin mouth is not integral with the conductive pin. In various embodiments the pin mouth is adapted to receive a central conductor of a coaxial cable (not shown) and to provide for electrical contact with the central conductor using contact(s) such as pin mouth tines 125.

Figure 2:
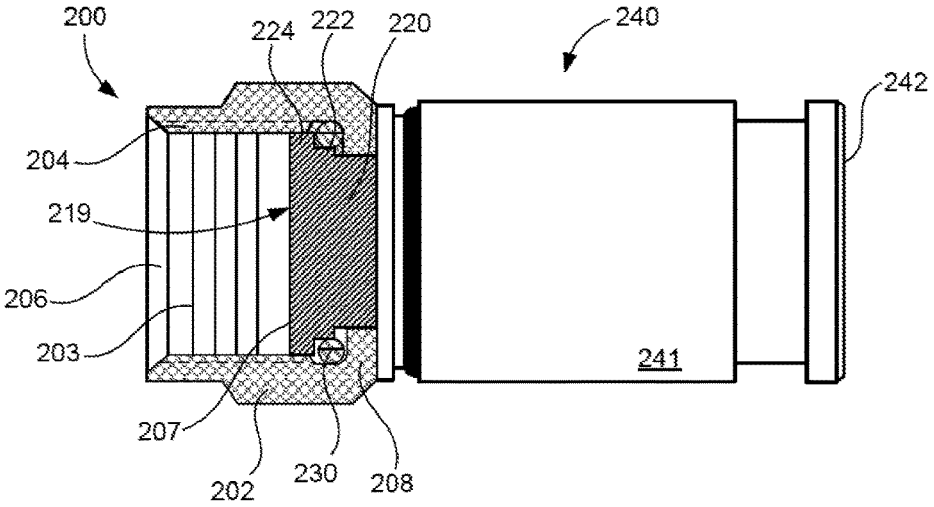
FIG. 2 PRIOR ART
FIG. 2 shows a prior art male F connector.

FIG. 2 shows a prior art male F connector 200. A central mandrel 219 engages each of a nut 202 and an outer sleeve 241. An installed coaxial cable (not shown) enters an outer sleeve mouth 242 and a coaxial cable center conductor extends from the mandrel 219 and through the nut 202.

The mandrel 219 includes a flange 224 and a shank 220 with a shoulder 222 there between. A trailing rim of the nut 208 encircles the mandrel shank and provides a rotatable engagement between the nut 202 and the mandrel. In some embodiments, an O-ring within the nut provides a means for sealing between the nut and the mandrel.

The nut includes means for engaging a female F connector. In an embodiment (as shown), a nut mouth 206 provides female F connector access and nut internal threads 203 provide for female F connector engagement. As further described below, the mandrel flange 224 presents a flange end-face 207 that is for engaging the female F connector end-face 107.

Figure 3A:
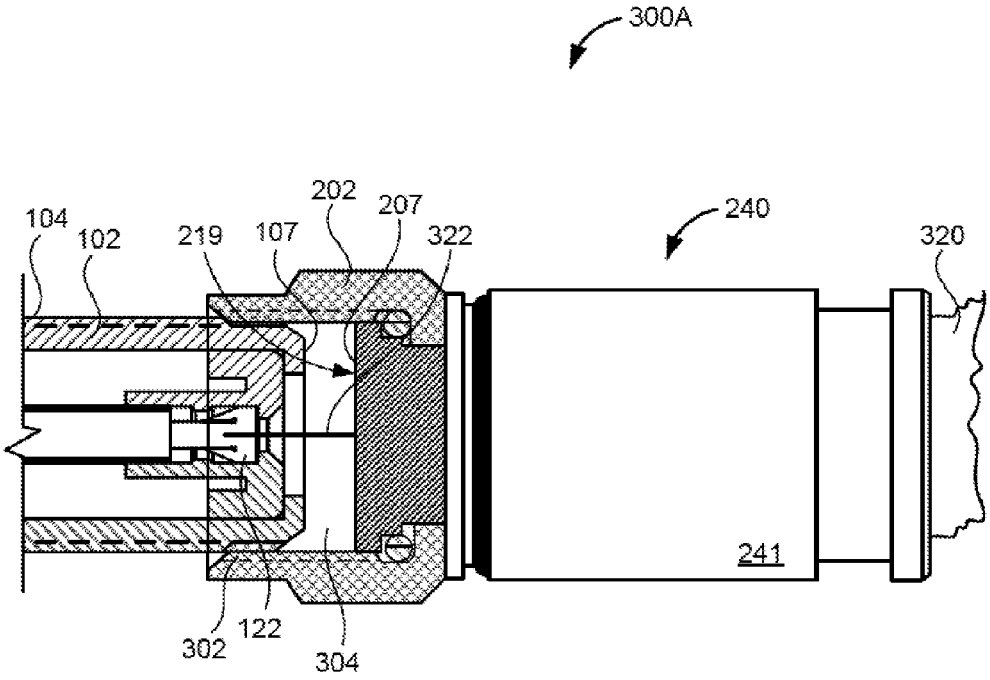
FIG. 3A PRIOR ART
FIG. 3A shows a first example of mated prior art F connectors.

FIG. 3A shows the F connectors of FIGS. 1 and 2 when they are engaged, but incompletely mated 300A. In this figure, the male F connector 200 is installed on a coaxial cable 320 such that a ground sheath of the coaxial cable (not shown) makes electrical contact with the mandrel 219 and a center conductor of the coaxial cable 322 makes electrical contact with the pin mouth 122. As persons of ordinary skill in the art will appreciate, the mandrel provides a part of an outer electrical path through the connectors and the pin mouth provides a part of an inner electrical path through the connectors.

The outer electrical path includes the coaxial cable ground sheath, the mandrel 219, the nut 202, and the female F connector body 102. As seen, the nut extends between and engages each of the body and the mandrel. In particular, nut internal threads 204 and body external threads 104 provide a means for engaging and disengaging the nut and the body 102 while the nut trailing rim 208 rotatably engages the mandrel.

Skilled artisans will recognize that electrical continuity along the outer electrical path is affected by the thread/thread engagement 302, a nut rim/mandrel engagement 308, 219, and a mandrel flange end-face/body end-face engagement 207, 107.

Figure 3B:
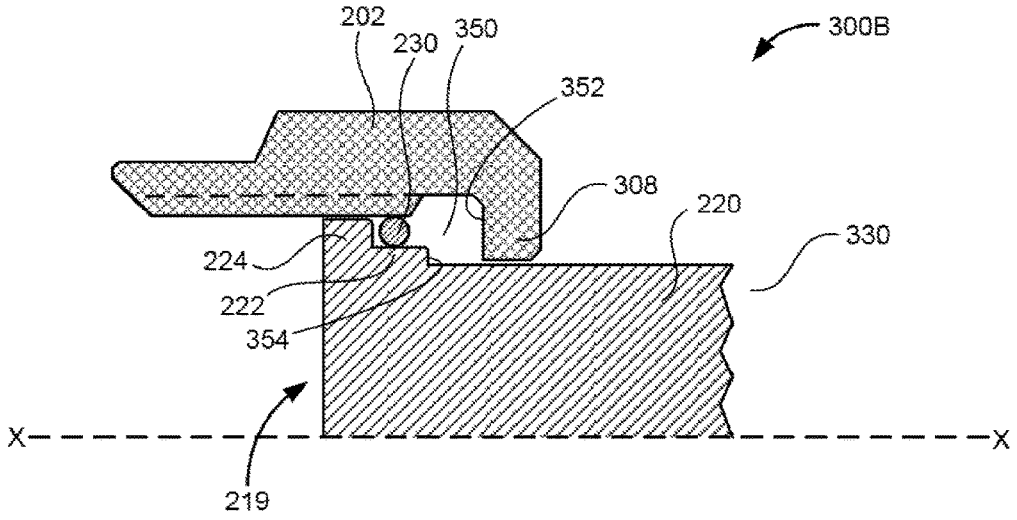
FIG. 3B PRIOR ART
FIG. 3B shows an enlarged view of a portion of a prior art male F connector.

FIG. 3B shows an enlarged view of the nut rim/mandrel engagement 300B. As seen, a rim front-face 352 is opposite a mandrel shoulder back-face 354. As the nut 202 moves away from the shank trailing end 330, the nut rim to shoulder gap 350 is reduced until the rim front-face engages the shoulder back-face. In various embodiments, nut and mandrel 219 geometries differing from the geometry of FIGS. 3A,B provide a similar engagement means, such as an angled, irregular, and/or stepped engagement, that is operated by motion of the nut relative to the mandrel.

As will now be appreciated, to the extent the nut 202 is loose, the electrical ground path between the mated connectors 100, 200 may be attenuated, disrupted, interrupted, and/or otherwise faulty, with deleterious effects on signal transmission.

Figure 4:
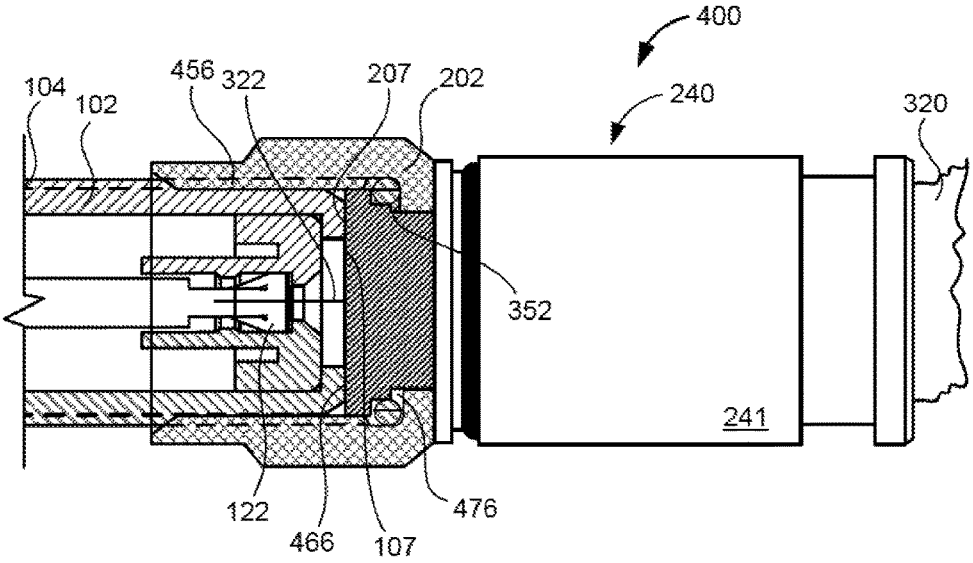
FIG. 4 PRIOR ART
FIG. 4 shows a second example of mated prior art F connectors.

FIG. 4 shows the prior art F connectors of FIGS. 1 and 2 when they are engaged and completely mated 400. Here, the nut 202 is advanced onto the F connector female body 102 sufficiently to bring the flange end-face 207 into contact with the generally opposed body end-face 107 as the nut rim front-face 352 tugs against the mandrel shoulder back-face 354.

In various embodiments, electrical conductivity engagements in the completely mated connectors include a nut-thread/body-thread engagement 456, a body end-face/mandrel flange end-face engagement 466, and a mandrel shoulder back-face/nut rim front-face gap or engagement 476. These can be referred to as the 1) thread/thread engagement, 2) end-face/end-face engagement, and 3) back-face/front-face engagement.

As seen, the prior art F connectors of FIGS. 1,2 rely on fully engaging a male connector nut 202 with a female connector body 102 to assure the connectors are completely mated. To the extent a male connector nut loosely engages a female connector body, only a thread/thread engagement 456 may exist while a first gap 304 separates the body end-face 107 from the flange end-face 207 and a second gap 350 separates the mandrel shoulder back-face 354 from the nut rim front-face 352.

Figure 5A:
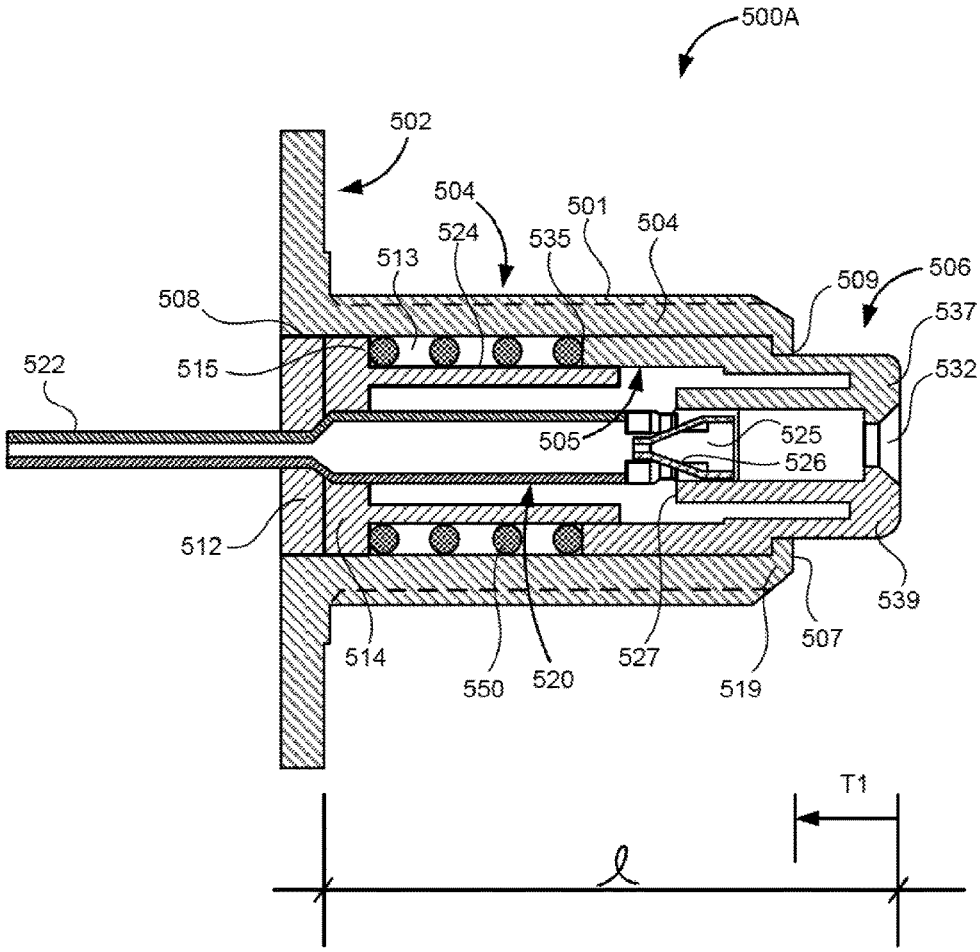
FIGS. 5A-D show a female coaxial connector port in accordance with the present invention.
Figure 5B:
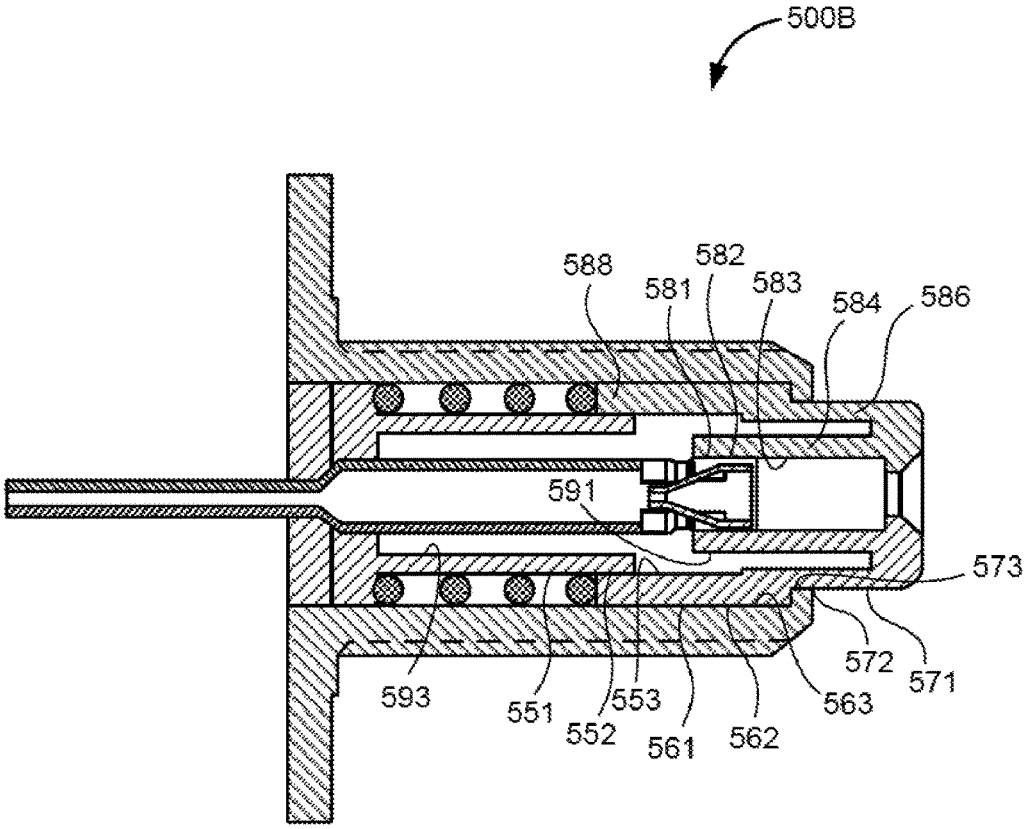

FIGS. 5A, 5B show a female F connector port with a spring activated nose 500A, 500B. A body 504 with external threads 501 extends from a connector base 502 and a moveable nose 506 protrudes 539 from a body cavity 513 at a body forward end 519.

Within the body 504 is a trailing portion of the nose 505 and a stand 514. The trailing portion of the nose slidably and/or telescopically engages the stand. In some embodiments, a base retainer 512 is inserted 508 in the body cavity 513, for example to position the stand 514. An elastic medium and/or device 550 tends to push the nose 506 away from the base 502 such that a protruding portion of the nose 539 extends from an aperture 509 at the body end face 507. The elastic medium or device can be any devise suited to the application such as a coil spring, compressible spring, elastic material, elastomeric band, gas filled device, or the like (referred to here as a "spring"). In an embodiment, the elastic medium or device is a compressible spring.

In an embodiment, the spring 550 encircles a stand periphery 524 such that it is between a nose rear-end 535 and a stand shoulder 515. Centrally mounted within the body 504 is a conductive pin 520 having a forward pin mouth 525 with tines 526 and a trailing post 522 extending through the stand 514 and the base retainer 512, if any. A nose passage in the protruding nose 532 enables a coaxial cable center conductor (not shown) to access the pin mouth. The pin mouth is slidingly inserted in a central socket of the nose 527 such that relative motion between the nose and the conductive pin occurs when the protruding nose 539 is pushed toward the base 502. Notably, the distance between the nose end-face 537 and the base 502 (representing a connector length l) is reduced when the spring 550 is compressed up to a distance T1.

In various embodiments, the nose 506 includes trailing walls such as a concentric short radius wall 584, mid radius wall 586, and long radius wall 588 forming portions of a plurality of sliding joints. For example plural of the following joints are formed in related embodiments. A forward joint 572 is formed between the mid-radius wall OD (outside diameter) 571 and a body forward end aperture lip 573. An inner central joint 582 is formed between the short radius wall ID (inside diameter) 583 and an outer surface of the pin mouth 581. An outer central joint 562 is formed between the long radius wall OD 561 and an inside wall of the body 563. A rear joint 552 is formed between the long radius wall ID 553 and a stand wall outer surface 551. An intermediate joint is formed between the mid radius wall OD 591 and an ID of the stand wall 593. As seen, a plurality of joints can be formed including: forward, inner central, outer central, rear, and intermediate joints.

As discussed in connection with FIG. 7 below, spring action of the nose urges mated connectors apart which tends to better bring mated threads into contact and to close gaps in connector parts such as gaps between a connector fastener/nut and a connector post flange. These actions are aimed at improving electrical continuity of the connector ground path and improving the electromagnetic containment and or shielding of the coaxial cable and connector center conductors.

Figure 5C:
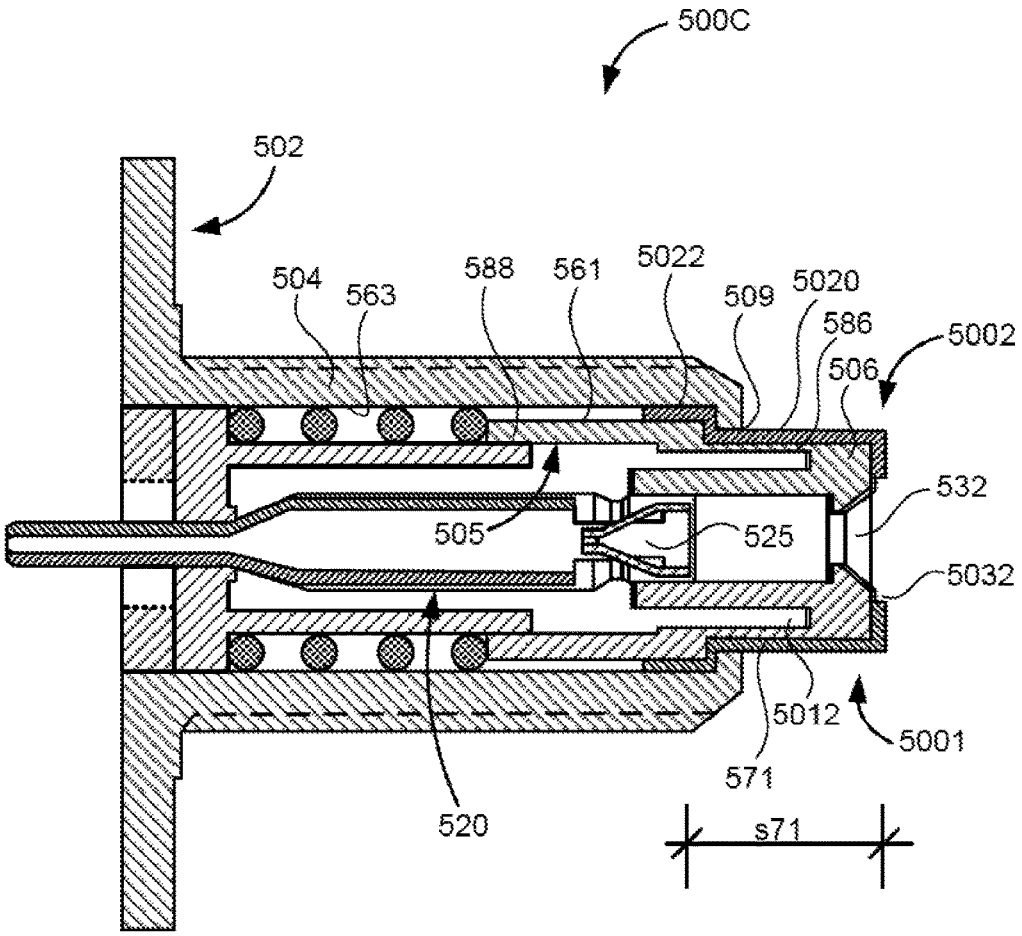

FIG. 5C shows 500C an enhanced version of a female F connector port of FIG. 5B. Here, embodiments of a nose assembly 5001 are configured to enhance electromagnetic shielding of center conductors.

In various embodiments, the nose assembly 5001 provides one or more of a) a nose 506 wholly or partially made from a material formulated to provide electromagnetic shielding, b) a nose 506 having an annular pocket 5012 surrounding connector and/or cable central conductor(s), the annular pocket containing an electromagnetic shielding material, and c) a nose 506 having a partial, substantially complete or complete outer covering that is an electromagnetic shield.

Embodiments include nose assemblies 5001 having a nose 506 wholly or partially made from a material formulated to provide electromagnetic shielding. Exemplary materials include plastics mixed with conductive material(s). Exemplary materials, methods, and structures provide the electromagnetic shielding while maintaining at least some surface electrical insulating properties for electrically isolating central conductor(s) from ground.

For example, thermoset plastics provide a matrix for immobilizing an electrical conductor such as a conductive metal, ferrite, carbon, carbon nanomaterial, and other materials known to skilled artisans as suitable materials. Frequently such electrical conductors will be finely divided however this is not necessary as, inter alia, encasement of conductors that are not finely divided within plastic will provide a shield. See also U.S. Pat. No. 4,783,279 filed Aug. 4, 1987 and U.S. Pat. No. 4,258,101 filed Aug. 4, 1978 each of which is incorporated herein in its entirety and for all purposes including in particular the disclosure of electromagnetic shielding.

In an embodiment, the mid radius wall 586 is formed from a thermoset plastic mixed with a finely divided conductor. In an embodiment, shielding additive concentration provides in a plastic structure that is not conductive. In an embodiment, the nose 506 is coated with an insulator such as an insulating paint.

Embodiments include a nose assembly 5001 having a nose 506 with an annular pocket 5012 surrounding connector and/or cable center conductor(s) wherein the annular pocket contains an electromagnetic shielding material. Any of the electromagnetic shield materials mentioned above may be used whether or not they are immobilized by a matrix material. In an embodiment, the pocket contains a finely divided conductor. In an embodiment, at least some of the pocket walls are coated with a shield material such as an acrylic coating pigmented with a high purity nickel flake (see e.g., MG Chemicals SuperShield™). In an embodiment, the pocket contains a cylindrical shield such as an electrically conductive cylinder, for example as a thin film aluminum cylinder. In some embodiments, the pocket contains a wire braid, mesh, or patterned fabric such as one of these materials rolled into a cylinder.

Embodiments include a nose 506 having a partial, substantially complete or complete outer covering enabling an electromagnetic shield. For example, the nose assembly 5001 of FIG. 5C shows an optional cap 5002 that might be formed by a number of different parts, coatings, laminates, and the like. Cap materials suitable for shielding include those mentioned above and those known to skilled artisans. In an embodiment, the cap is a metallic cap such as an aluminum cap.

The cap shown 5002 envelops the protruding nose 506 while providing a cap passage 5032 about coextensive with the nose passage 532 for receiving a center conductor of a mating connector (not shown). As the nose 506 moves in and out of the body end face aperture 509 and slides over the conductive pin 520, the cap moves together with it.

Figure 5D:
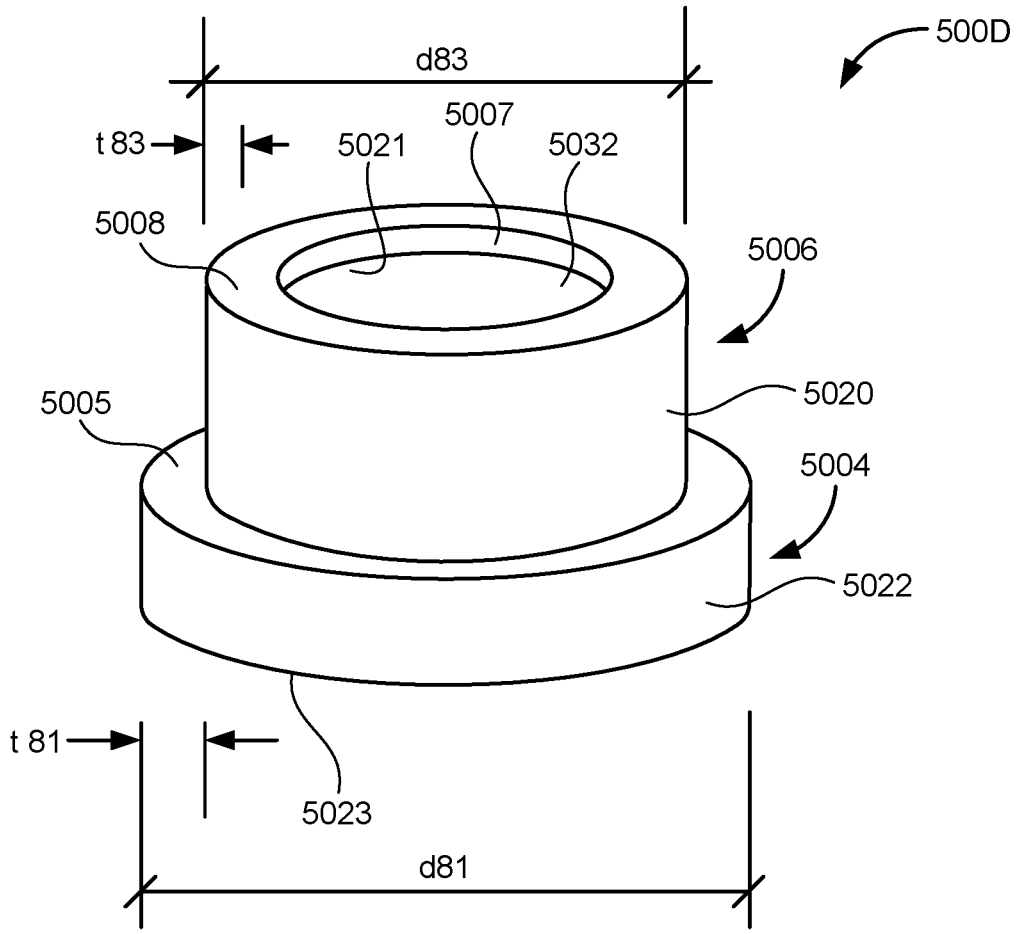

FIG. 5D shows a cap embodiment 500D. As shown, the cap has a base 5004 adjoining a cap projection 5006 with an end rim 5007 and end rim end face 5008. Smaller in diameter d83 than the base diameter d81, the cap projection meets the cap base as a cap shoulder 5005. In various embodiments, an installed cap has a base inside surface 5023 adjacent to the long radius wall OD 561, a base outside surface 5022 adjacent to a connector body inside wall 563, a projection inside surface 5021 adjacent to the mid range wall OD 571, and a projection outside surface 5020 slidably engaged with the body aperture 509. Measures t81 and t83 indicate wall thicknesses of the base and projection respectively.

In various ones of the embodiments described in connection with FIGS. 5C and 5D, an electromagnetic shield is formed around center conductor(s) of the cable and/or connector(s). This shield is carried with the nose such that electromagnetic shielding is not only enhanced when connectors are mated, shielding is also enhanced when the port of FIG. 5C is open and where a shield of length s71 isolates the connector center conductor including the conductive pin 520 and forward pin mouth 525 from unwanted RF signal ingress.

Figure 6A:
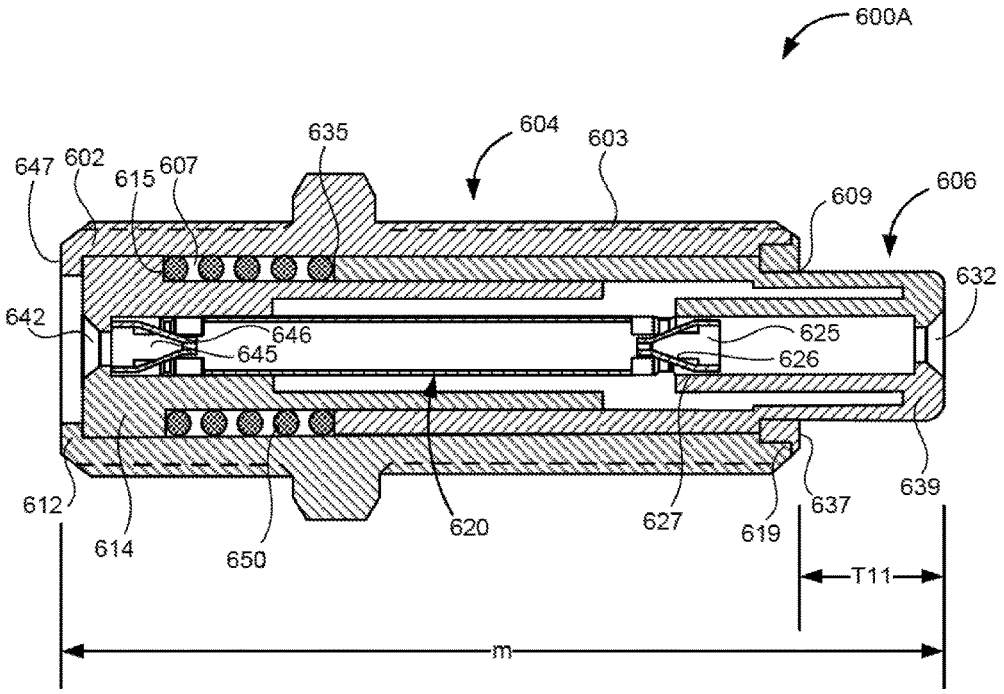
FIGS. 6A-D show a coaxial connector splice in accordance with the present invention.
Figure 6B:
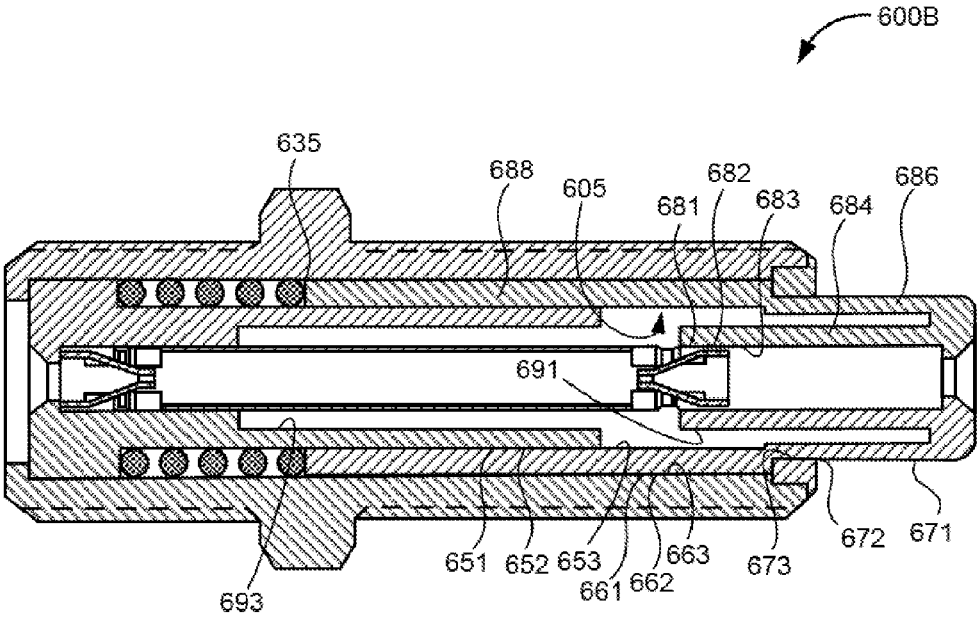

FIGS. 6A, 6B show an F connector splice with a spring activated nose 600A, 600B. A connector body 604 has external threads 603 and a moveable nose 606 that protrudes 639 from a body cavity 607 at a body forward end 619.

Within the body 604 is a trailing portion of the nose 605 and a socket stand 614. The trailing portion of the nose 605 slidably and/or telescopically engages the socket stand. In some embodiments, a body rim 612 partially closes the body cavity 607, for example to position the socket stand 614. An elastic medium and/or device such as a compressible spring 650 tends to push the nose 606 away from the end opposite the forward end 602 such that a protruding portion of the nose 639 extends from an aperture in the body end face 609. In an embodiment, the spring encircles the socket stand 614 such that it is between a nose rear-end 635 and a socket stand shoulder 615.

Centrally mounted within the body 604 is a conductive pin 620 having a forward pin mouth 625 with tines 626 and a trailing pin mouth 645 with tines 646. A nose passage in the protruding nose 632 enables a first coaxial cable center conductor (not shown) to access the pin mouth 625. A socket stand passage 642 enables a second coaxial cable center conductor (not shown) to access the opposed pin mouth 645. The forward pin mouth is slidingly inserted in a central socket of the nose 627 such that relative motion between the nose and the conductive pin occurs when the protruding nose 639 is pushed toward the socket stand 614. Notably, the distance between the nose end-face 637 and a connector opposed end face 647 (representing a connector length m is reduced when the spring 650 is compressed up to a distance T11.

In various embodiments, the nose 606 includes trailing walls such as a concentric short radius wall 684, mid radius wall 686, and long radius wall 688 forming portions of a plurality of sliding joints. For example plural of the following joints are formed in related embodiments. A forward joint 672 is formed between the mid-radius wall OD (outside diameter) 671 and a body forward end aperture lip 673. An inner central joint 682 is formed between the short radius wall ID (inside diameter) 683 and an outer surface of the pin mouth 681. An outer central joint 662 is formed between the long radius wall OD 661 and an inside wall of the body 663. A rear joint 652 is formed between the long radius wall ID 653 and a socket stand wall outer surface 651. An intermediate joint is formed between the mid radius wall OD 691 and an ID of the socket stand wall 693. As seen, a plurality of joints can be formed including: forward, inner central, outer central, rear, and intermediate joints.

Figure 6C:
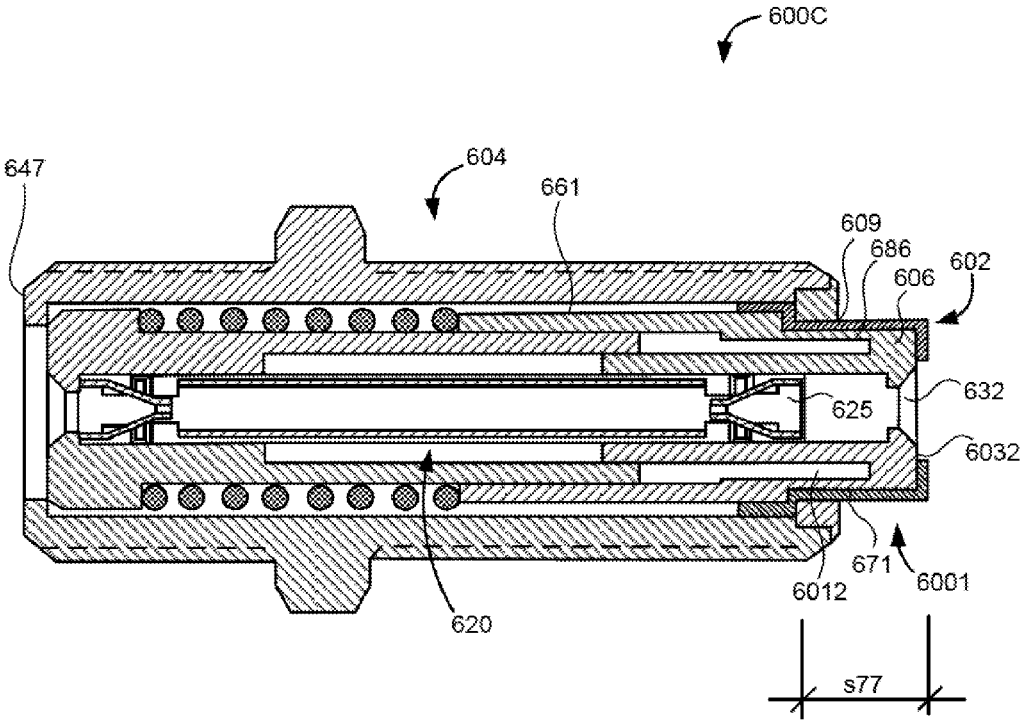

FIG. 6C shows 600C an enhanced version of an F connector splice of FIG. 6B. Here, embodiments of a nose assembly 6001 are configured to enhance electromagnetic shielding of center conductors.

In various embodiments, the nose assembly 6001 provides one or more of a) a nose 606 wholly or partially made from a material formulated to provide electromagnetic shielding, b) a nose 606 having an annular pocket 6012 surrounding connector and/or cable central conductor(s), the annular pocket containing an electromagnetic shielding material, and c) a nose 606 having a partial, substantially complete or complete outer covering that is an electromagnetic shield.

Embodiments include nose assemblies 6001 having a nose 606 wholly or partially made from a material formulated to provide electromagnetic shielding. Exemplary materials include plastics mixed with conductive material(s). Exemplary materials, methods, and structures provide the electromagnetic shielding while maintaining at least some surface electrical insulating properties for electrically isolating central conductor(s) from ground.

For example, thermoset plastics provide a matrix for immobilizing an electrical conductor such as a conductive metal, ferrite, carbon, carbon nanomaterial, and other materials known to skilled artisans as suitable materials. Frequently such electrical conductors will be finely divided however this is not necessary as, inter alia, encasement of conductors that are not finely divided within plastic will provide a shield.

In an embodiment, the mid radius wall 686 is formed from a thermoset plastic mixed with a finely divided conductor. In an embodiment, shielding additive concentration provides in a plastic structure that is not conductive. In an embodiment, the nose 606 is coated with an insulator such as an insulating paint.

Embodiments include a nose assembly 6001 having a nose 606 with an annular pocket 6012 surrounding connector and/or cable center conductor(s) wherein the annular pocket contains an electromagnetic shielding material. Any of the electromagnetic shield materials mentioned above may be used whether or not they are immobilized by a matrix material. In an embodiment, the pocket contains a finely divided conductor. In an embodiment, at least some of the pocket walls are coated with a shield material such as an acrylic coating pigmented with a high purity nickel flake (see e.g., MG Chemicals SuperShield™). In an embodiment the pocket contains a cylindrical shield such as an electrically conductive cylinder, for example as a thin film aluminum cylinder. In some embodiments, the pocket contains a wire braid, mesh, or patterned fabric such as one of these materials rolled into a cylinder.

Embodiments include a nose 606 having a partial, substantially complete or complete outer covering enabling an electromagnetic shield. For example, the nose assembly 6001 of FIG. 6C shows an optional cap 6002 that might be formed by a number of different parts, coatings, laminates, and the like. Cap materials suitable for shielding include those mentioned above and those known to skilled artisans. In an embodiment, the cap is a metallic cap such as a cap including one or more of brass, brass alloys, aluminum, and aluminum alloys.

The cap shown 6002 envelops the protruding nose 606 while providing a cap passage 6032 about coextensive with the nose passage 632 for receiving a center conductor of a mating connector (not shown). As the nose 606 moves in and out of the body end face aperture 609 and slides over the conductive pin 620, the cap moves together with it.

Figure 6D:
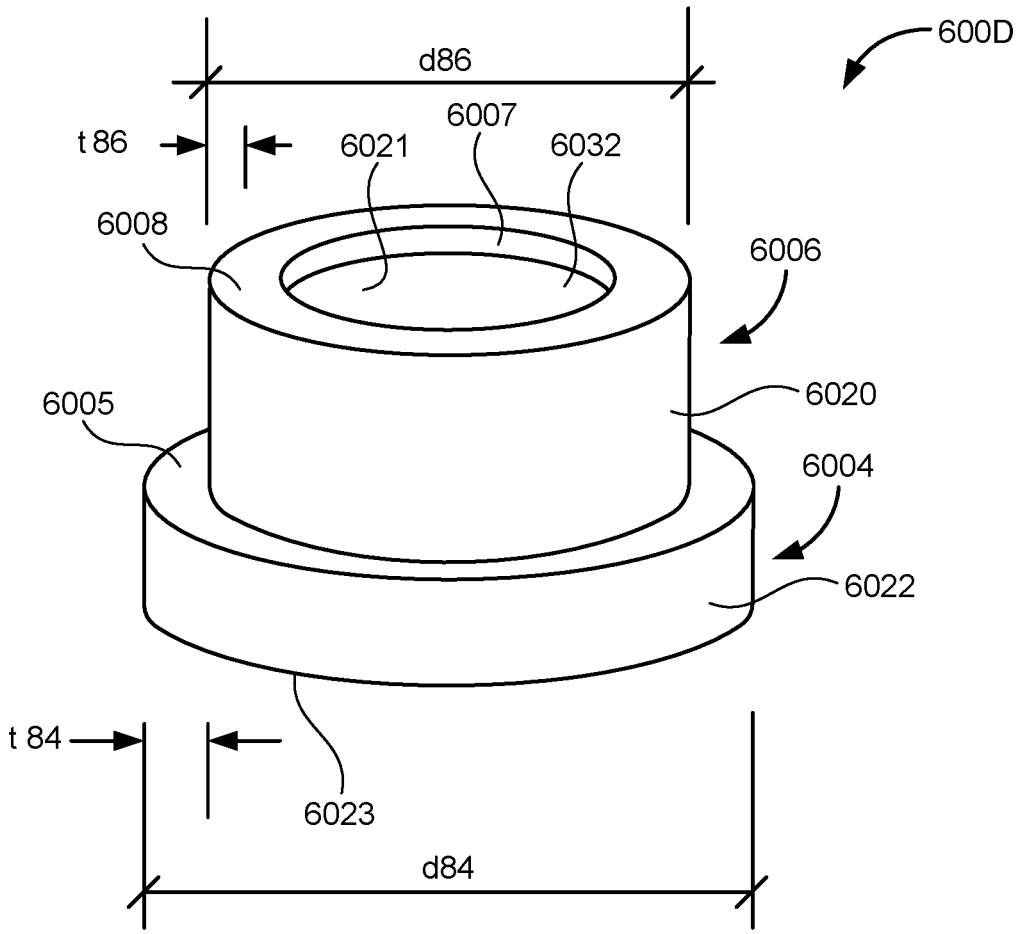

FIG. 6D shows a cap embodiment 600D. As shown, the cap has a base 6004 adjoining a cap projection 6006 with an end rim 6007 and end rim end face 6008. Smaller in diameter d86 than the base diameter d84, the cap projection meets the cap base as a cap shoulder 6005. In various embodiments, an installed cap has a base inside surface 6023 adjacent to the long radius wall OD 661, a base outside surface 6022 adjacent to a connector body inside wall 663, a projection inside surface 6021 adjacent to the mid range wall OD 671, and a projection outside surface 6020 slidably engaged with the body aperture 609. Measures t84 and t86 indicate wall thicknesses of the base and projection respectively.

In various ones of the embodiments described in connection with FIGS. 6C and 6D, an electromagnetic shield is formed around center conductor(s) of the cable and/or connector(s). This shield is carried with the nose such that electromagnetic shielding is not only enhanced when connectors are mated, shielding is also enhanced when the port of FIG. 6C is open and where a shield of length s77 isolates the connector center conductor including the conductive pin 620 and forward pin mouth 625 from unwanted RF signal ingress.

Figure 7A:
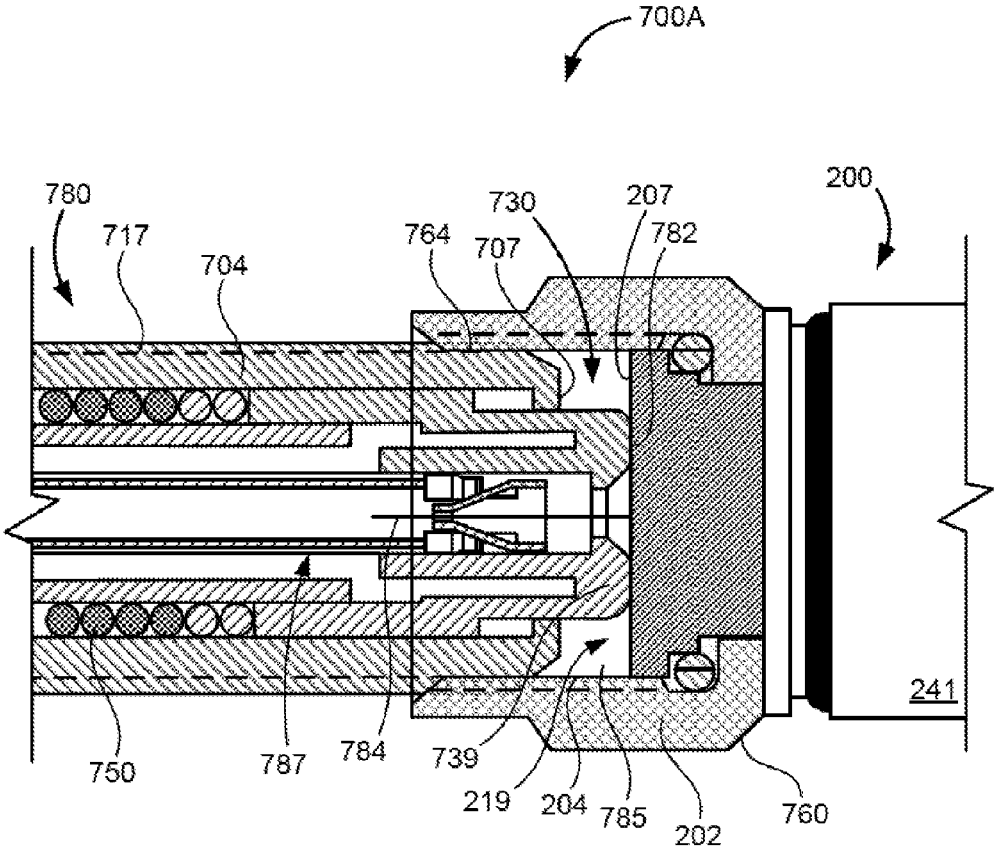
FIG. 7A shows a first example of a mated female coaxial connector in accordance with the present invention.
Figure 7B:
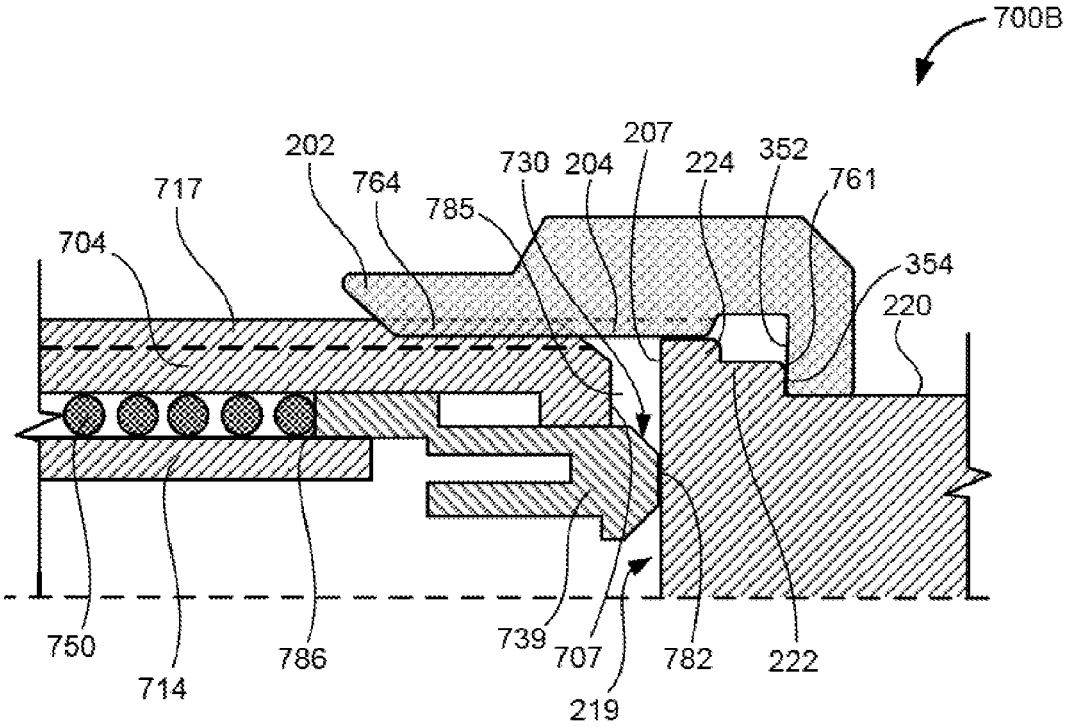
FIG. 7B shows an enlarged portion of FIG. 7A.
Figure 7C:
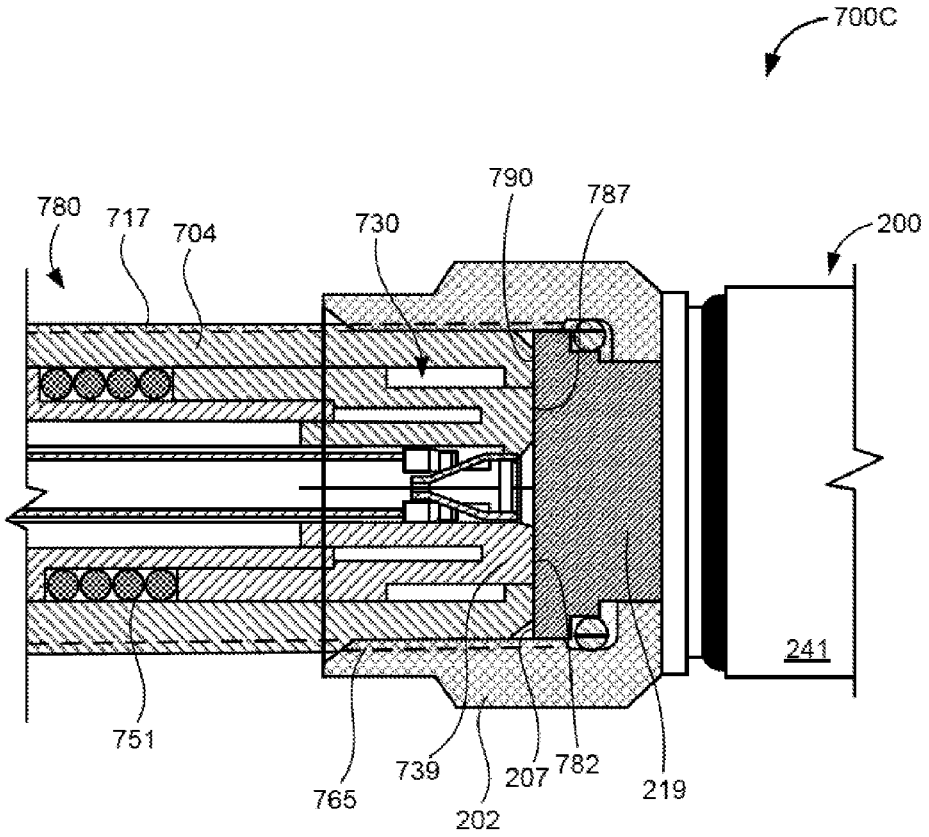
FIG. 7C shows a second example of a mated female coaxial connector in accordance with the present invention.

FIG. 7A shows a male F connector that is engaged, but partially mated with a female F connector including a spring activated nose 700A. FIG. 7B shows an enlarged view 700B of engagement portions of the mated connectors of FIG. 7A. FIG. 7C shows complete mating 700C of the male and female F connectors of FIG. 7A.

As skilled artisans will recognize, F connectors of various sorts other than those described above can benefit from embodiments of the present invention. For example, nose actuating springs need not be located within a connector body. Embodiments having female coaxial connectors that are part of a larger device may, for example, have a nose actuating spring located outside the connector body. Examples include a spring located on the device but apart from the connector body.

In FIG. 7A, a male F connector 200 is engaged and partially mated with a female F connector portion 780. External threads 717 of the female connector 780 are engaged 764 with internal threads 204 of the male connector nut 202. As shown, the engagement provides only a partial mating as seen by the gap 785 between the female connector end face 707 and the flange face 207 of the male connector mandrel 219.

However, unlike prior art connectors, the male connector 200 is nevertheless urged away from the female connector 780 by the spring actuated nose 730. Forces tending to separate the connectors are exchanged at a nose/mandrel contact 782 where the nose 730 meets the mandrel face 207. Resisting the tendency of the nose to push the connectors apart is a first nut engagement where nut and body threads are urged to interengage 764 and a second nut engagement where the nut rim front face is urged to contact the mandrel shoulder back face 760.

As persons of ordinary skill in the art will appreciate, a tendency of the nose to hold partially mated connectors apart improves the electromagnetic containment surrounding coaxial cable central conductor(s) 784 and conductive center pin(s) 787. In particular, spring rate (k [kg/mm]) and spring compression (d [mm]) will determine and/or influence strongly the degree of contact and contact forces developed at the nut engagements 764, 760 of partially mated connectors. In various embodiments, connector geometry and values of k and d are chosen to reduce ingress of unwanted signals into mated connectors by amounts ranging from 3 to 40 decibels.

FIG. 7B shows an enlarged view 700B of the nose contact and nut engagements of the partially mated connectors of FIG. 7A. As seen, the protruding portion of the nose 739 extends from the female connector body 704 and contacts 782 the mandrel flange face 207. The spring 750 encircles a stand-like portion 714 and pushes against a nose back face 786. The female connector external body threads 717 interengage 764 with the nut internal threads 204. In some embodiments, the mandrel shoulder back face 354 contacts 761 the forward face of the nut rim 352 (as shown).

FIG. 7C shows the male and female connectors of FIG. 7A after they are engaged and completely mated 700C. As seen, the protruding nose portion 739 no longer protrudes from the female connector body 704. Rather, the end face of the protruding nose 787 is about flush with the end face of the body 707, the protruding nose end face 787 contacts 782 the mandrel flange face 207, and the body end face 707 contacts 790 the mandrel flange face 207. As persons of ordinary skill in the art will recognize, contact between the female connector body and the male connector mandrel enhances electrical continuity between the shield or ground of the male connector and the shield or ground of the female connector.

Notably, when the protruding nose is pressed into the female connector body, the spring 751 is compressed and the gap 785 is closed or substantially closed, male-female connector thread engagement 765 is tightened, and the nut rim front face 352 is tightly engaged with the mandrel shoulder back face 354.

As can be seen, tightly mated male and female connectors 200, 780 provide for enhanced electromagnetic containment of connector center pin(s) 787 and corresponding conductor(s) of coaxial cable(s). In lieu of tight mating, embodiments of the present invention enhance the stray signal rejection capabilities of loosely engaged connectors benefiting from the spring actuated nose.

Figure 8A:
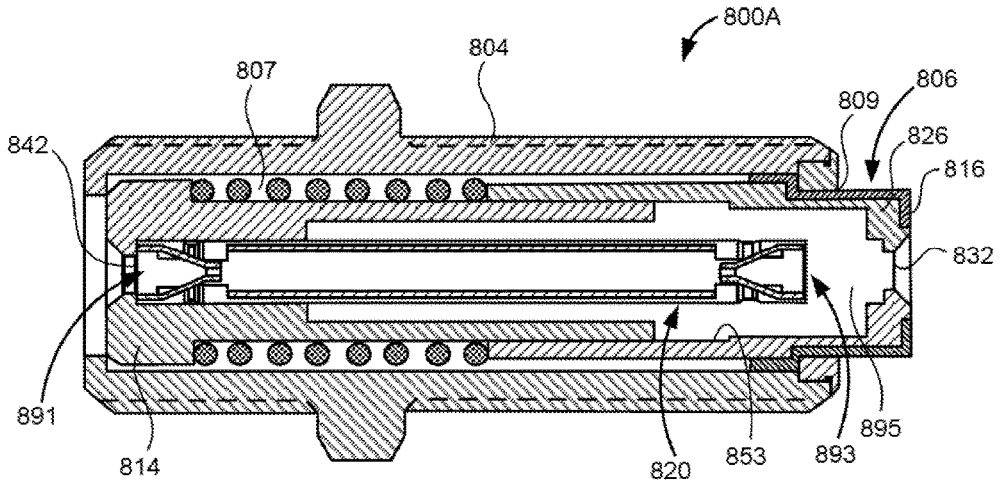
FIGS. 8A-B show cantilevered center conductor coaxial connector splices in accordance with the present invention.
Figure 8B:
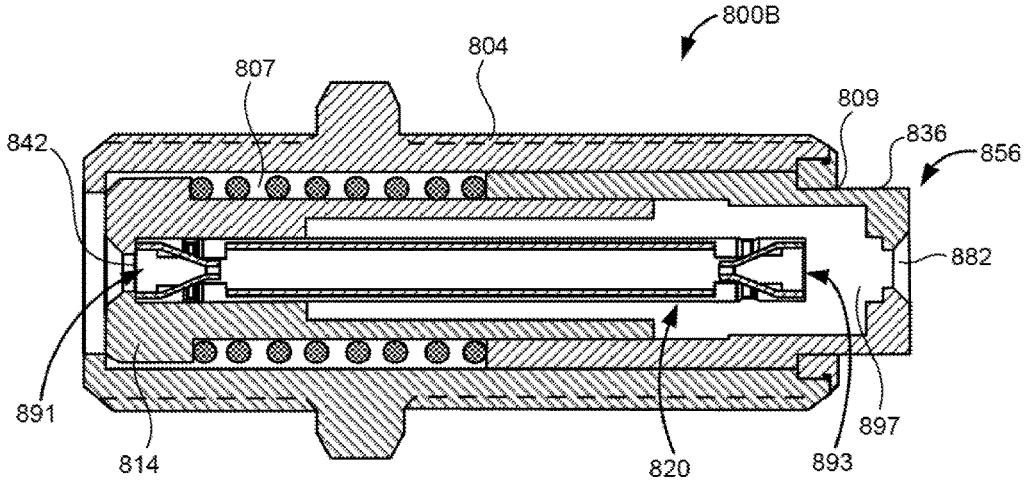

FIGS. 8A-B show F connector splices 800A, 800B. In particular, in similar fashion to FIGS. 6A-C, a connector body 804 receives into a connector body cavity 807 a socket stand 814 and a moveable nose 806. In some embodiments, the moveable nose includes a bore 853 for telescopic arrangement with the socket stand. The moveable nose protrudes from a body end face aperture 809. Passages in the socket stand 842 and moveable nose 832, 882 are for receiving a center conductor of a coaxial cable. As shown, the passages provide access to a conductive pin 820 that is about centrally located in the body cavity. A first end of the conductive pin 891 is supported by the socket stand while an opposed second end of the conductive pin 893 extends into an area of the movable nose such as a cavity 895, 897 of the nose 806, 856. In various embodiments, the second end of the conductive pin is not supported by the moving nose. And, in various embodiments, the second end of the conductive pin is cantilevered (as shown).

FIG. 8A shows the moveable nose 806 having a nose base such as a non-magnetically shielding nose base 826 inserted in an electro-magnetically shielding nose cap such as a metallic nose cap 816. Moving with the nose, the nose cap shields the adjacent conductive pin end 893, particularly when no connector is mated with the movable nose end of the splice 809.

FIG. 8B shows the moveable nose 856 with electromagnetic nose part shielding 836 in all of or in a portion of the nose. In various embodiments the nose part may be treated to provide magnetic shielding and in various embodiments the nose part is coextensive with the moveable nose. Treatments may include surface treatments such as coatings, platings, and embedments. Treatments may also include magnetically shielding portions of a mixture from which the nose part is made. For example, finely divided metal(s) may be suspended in a polymer substrate to provide at least a portion of the nose part with the desired shielding properties. Understandably, skilled artisans will, upon seeing applicant's disclosure, recognize other embodiments that implement applicant's teaching. For example, FIGS. 8A-B may be modified according to applicant's related teaching above.

FIGS. 8C-G show stationary insulator coaxial connector splices 800C-G in accordance with the present invention.

Figure 8C:
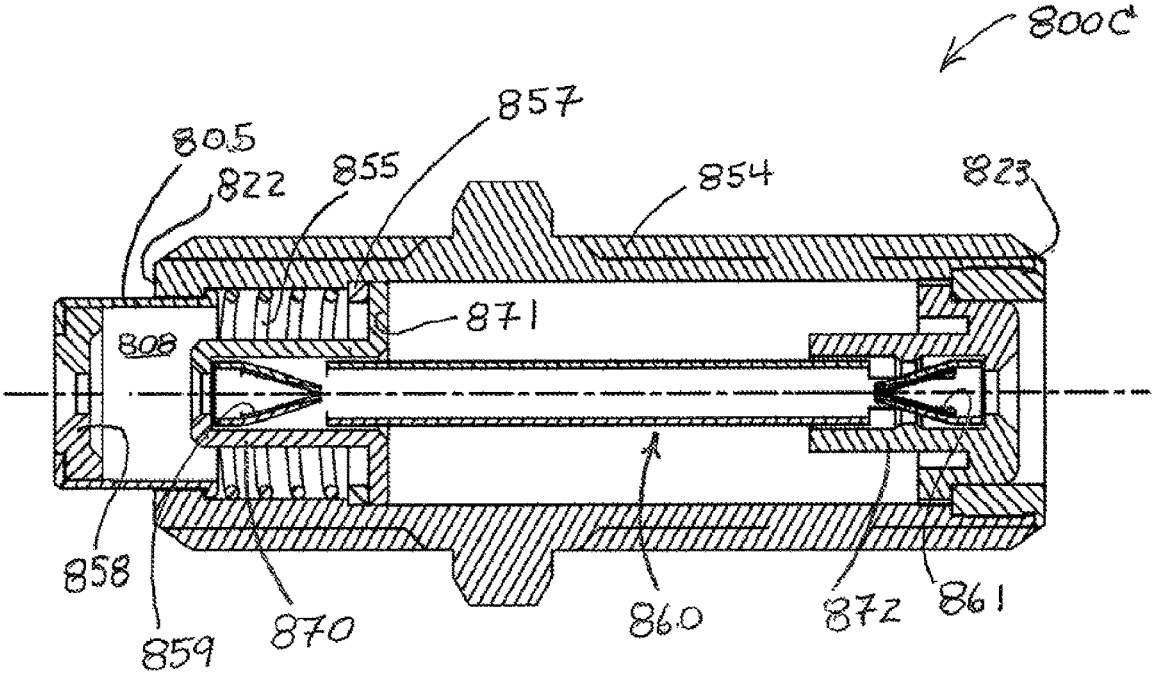
FIGS. 8C-G show stationary insulator coaxial connector splices in accordance with the present invention.

FIG. 8C shows a splice 800C with stationary first and second insulators 870, 872. A connector body such as a metal or metalized hollow body 854 extends between first and second body ends 822, 823.

Near the first body end 822, a spring 855 is for urging a nose configured to protrude from the body first end. Embodiments of the nose include those mentioned above. For example, the nose may be electrically non-conductive such as a plastic nose or the nose may be electrically conductive such as a metal, metal capped, or otherwise metalized nose 805. In various embodiments, an electrically conductive nose provides an electromagnetic shield against stray RF signals.

The spring is situated substantially between the nose and the first insulator 870 and may bear on an optional annular support ring 857 or on the first insulator such as on a base portion 871 of the first insulator. At least portions of the first insulator 870 and a connector center conductor 860 may be encircled by the spring 855.

In some embodiments, the annular support ring 857 is an electrical conductor in a signal path between an electrically conducting nose 805 and an electrically conductive body that includes an electrically conducting spring 855.

The nose 805 is configured to receive a mating center conductor (not shown) via a passageway through the nose 808. In various embodiments, a disc 858 inserted in or integral with the nose 805 provides an aperture 836 for passage of the mating center conductor. As shown, the disc is a generally annular structure.

Where a disc held by an electrically conductive nose 805 is employed, protection against grounding a mating center conductor to the nose may be provided. For example, one or more of the following structures may be employed: a disc made of or including insulating material; a layer of insulating material included in the interface between the nose and the disc 811; an electrically conductive coating applied to surface(s) of an insulator disc; electrically conductive material included in a plastic matrix that forms the disc while insulating surface(s) of the disc; and, the like. As skilled artisans will appreciate, these insulating techniques are exemplary and provide for cases including noses and/or discs that conduct electricity and/or shield against radio frequency signals.

The second insulator 872 is located near the second body end 823. As shown, the connector center conductor 860 spans between the insulators 870, 872 and in various embodiments the insulators support the center conductor near center conductor ends such as proximate first and second center conductor sockets 859, 861.

Figure 8D:
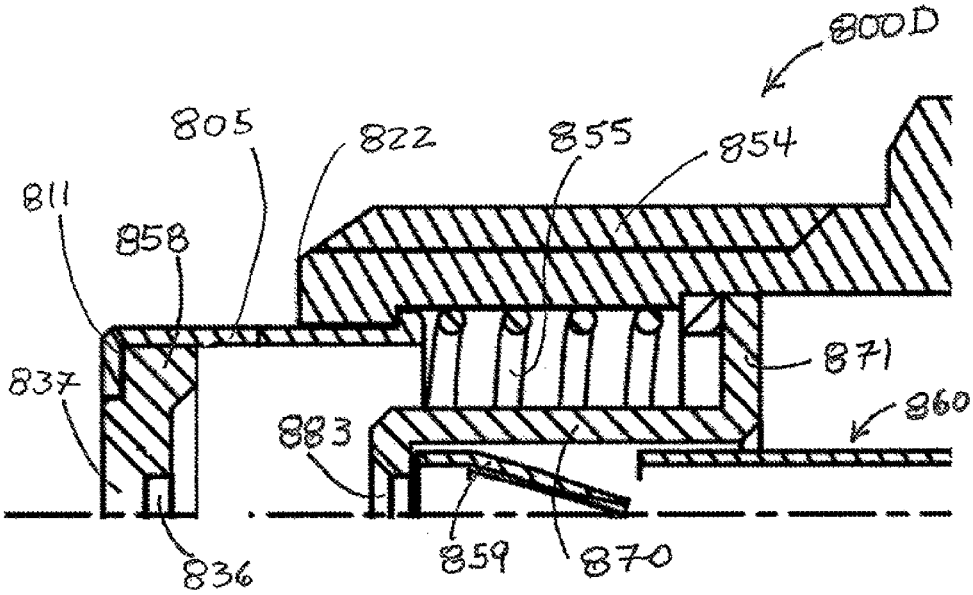

FIG. 8D shows an enlarged portion of the connector spring assembly 800D. As seen, the spring 855 urges the nose 805 to protrude from the first body end 822. The nose is designed to be pushed into the body when engaged by a male coaxial connector (not shown). Skilled artisans will appreciate that noses such as metal noses provide an electromagnetic shield separating body internals such as the center conductor 860 from radio frequency signals that originate external to the body. In particular embodiments, the nose substantially closes the first body end 822 but for a passageway for passing a mating coaxial connector center conductor. In some embodiments, a disc 858 provides a chamfered entry 837 and/or a waveguide for blocking ingress of undesired signals such as signals in CATV frequency ranges including a low frequency range of 10 to 100 MHz and a high frequency range of 100 to 2150 MHz.

Figure 8E:
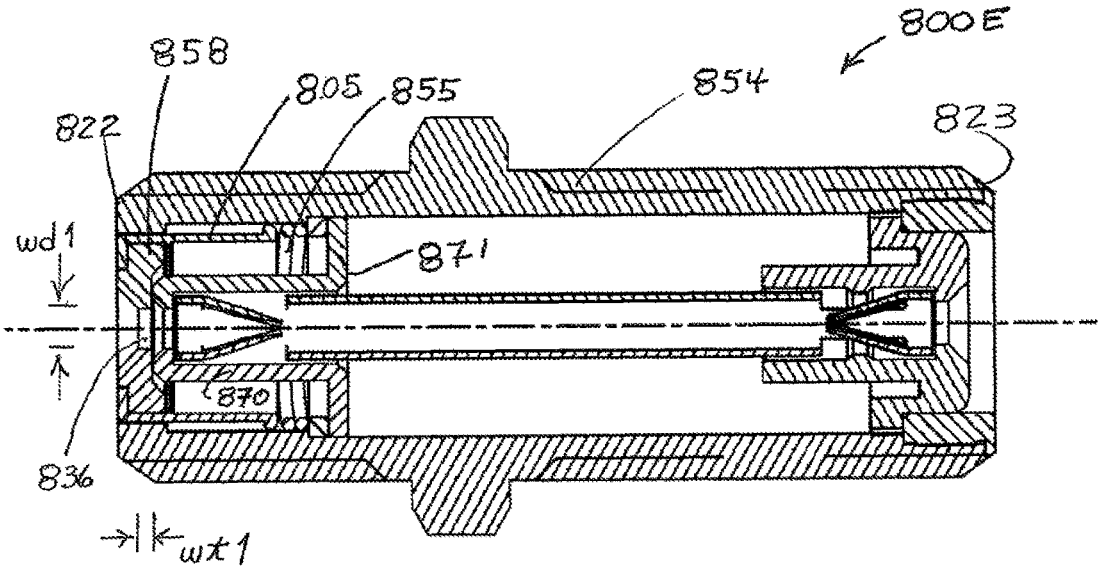

FIG. 8E shows the connector of FIG. 8C with the nose depressed 800E. As seen, depressing the nose causes the spring 855 to be compressed as when a mating coaxial connector (not shown) is fully engaged as the first end 822 of the connector 800E.

As mentioned in connection with FIG. 8E, some embodiments employ a disc suitable for blocking and/or reducing undesired signal ingress via the nose 805 into an open connector 800C. The dimensions of such a disc or waveguide are illustrated in FIG. 8E showing a waveguide aperture diameter of "wd1" and a waveguide aperture thickness of "wt1." As explained in applicant's copending applications referenced above, waveguide aperture sizes found useful in CATV applications vary from a diameter of 1.5 to 3.0 mm while corresponding waveguide aperture thicknesses vary from 0.5 to 2.0 mm. In various embodiments, a waveguide aperture has a maximum dimension of 3.0 mm and in various embodiments, a waveguide aperture has a diameter of 3.0 mm. As skilled artisans will understand, these and/or similar waveguides may be used in other connectors such as the coaxial connector of FIGS. 5A, 6A, 7A, and 8A.

Figure 8F:
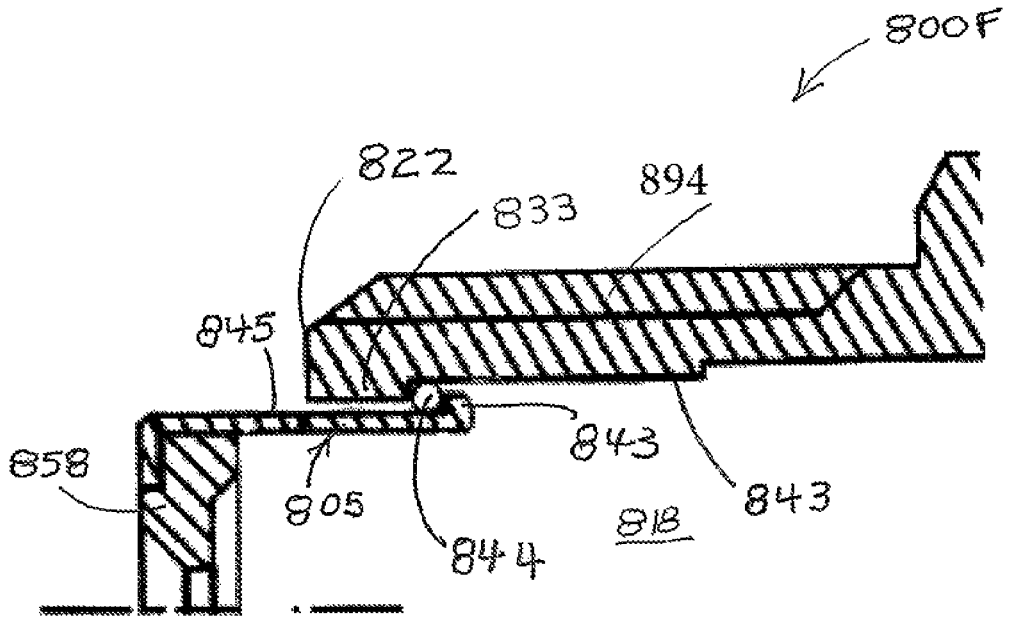
Figure 8G:
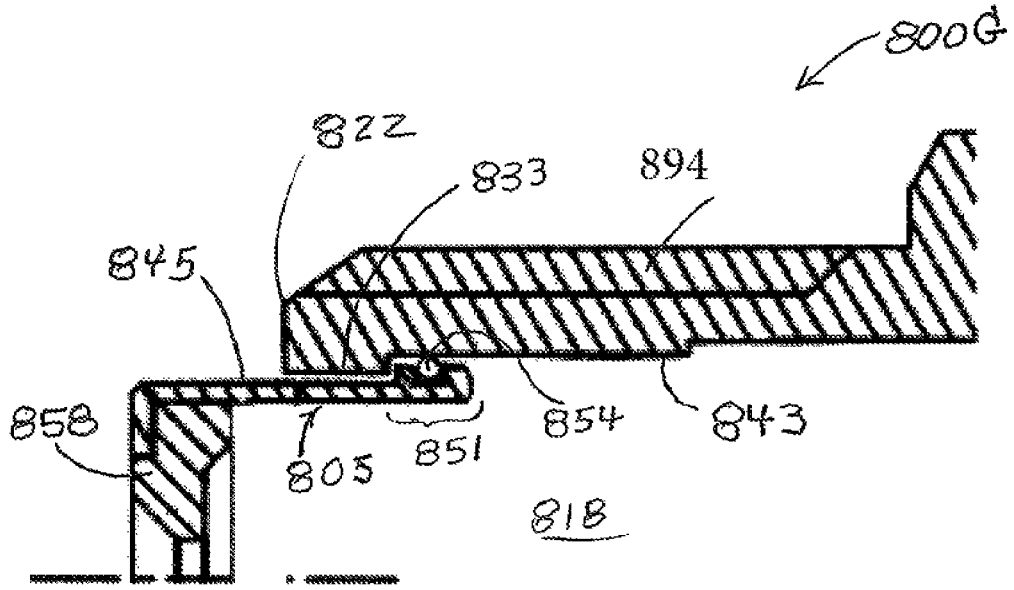

FIGS. 8F-G show enlarged views of noses and ground wipers 800F-G. As skilled artisans will appreciate, electrically conductive noses and in particular radio frequency noise shielding noses share a ground with the connector body 894. Because the nose moves relative to the body, the shared ground may be intermittent at times even if a nose exterior surface 845 is designed to drag on a body part such as a body neck 833 surrounding the nose.

In various embodiments, a ground wiper may be used improve the integrity of the ground shared by the nose 805 and the body 854. In particular, some embodiments employ a resilient ground wiper interconnecting and/or extending between the nose and the body.

FIG. 8F shows a resilient ground wiper 844 located within the body 818. The resilient ground wiper may be any electrically conductive structure suited for engagement such as radial engagement in an annular zone such as the zone between the nose exterior surface 845 that faces a body interior surface 843. In the embodiment shown, a nose end shoulder 843 and the body neck 833 provide means for containing a resilient structure such a coil spring having a centerline encircling the nose. Other resilient structures such as electrically conductive and/or composite O-Rings, resilient metal fingers such as fingers integral, or not, with the nose and/or the body, undulating metallic loops such as spring loops, brushes such as wire brushes, and the like may be used.

FIG. 8G shows a resilient ground wiper 854 located within the body 818. The resilient ground wiper may be any electrically conductive structure suited for engagement such as radial engagement in an annular zone such as the zone between the nose exterior surface 845 that faces a body interior surface 843. In the embodiment shown, a nose 805 includes a shouldered end groove portion 851 for holding a ground wiper such as a coil spring having a centerline encircling the nose. Bounded by a body neck 833 and the shouldered end groove portion of the nose, a ground wiper otherwise prone to dislocation is kept in the annular zone. Other resilient structures such as electrically conductive and/or composite O-Rings, resilient metal fingers such as fingers integral, or not, with the nose and/or the body, undulating metallic loops such as spring loops, brushes such as wire brushes, and the like may be used.

In operation, the connector of FIG. 8A can provide an electromagnetic nose and/or a waveguide that shields a connector center conductor when the connector is unmated and when the connector is incompletely mated with another connector. Where the spring urged nose engages an end of a loosely mated second connector, grounding between the mated connectors is enhanced when spring forces tending to separate the connectors also enhance electrical contact between connector mating surfaces. For example, in an F connector internal fastener threads of a mating connector will be pulled against connector external threads thereby enhancing the electrical ground that extends between the mated connectors. Further, when the nose presses against the end of the second connector, the electrical ground between the mated connectors is enhanced yet again.

FIGS. 9A through 22E show embodiments of center conductors useful in coaxial connectors. Exemplary uses include use in one or more of a single ended coaxial connector and a double ended coaxial connector. In particular, the double ended center conductor of FIG. 9A, and its various embodiments which follow, may be used in connectors such as those of FIGS. 6A-C, and 8A-C. Further, the single ended center conductor of FIG. 9B, and its various embodiments which follow, may be used in connectors such as those of FIGS. 5A-C. To distinguish these connector center conductors from other center conductors common in coaxial electrical connections, they are referred to below as "seizing conductors."

Figure 9A:
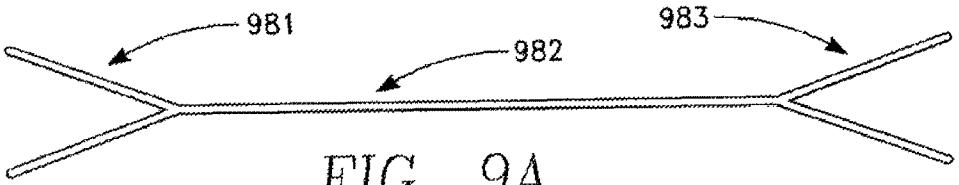
Figure 9B:
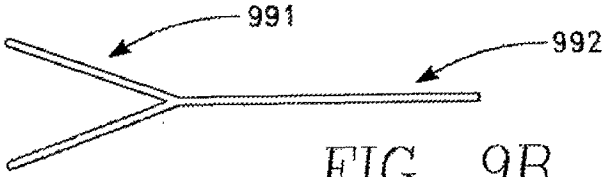

FIGS. 9A-B show schematic views of two seizing conductors.

FIG. 9A shows a schematic view of a double ended seizing conductor that includes first and second generally opposed jaws 981, 983. The jaws are for grasping center conductors of respective mating connectors. Exemplary mating center conductors include coaxial cable center conductors and fixed pin center conductors.

A link 982 interconnecting the jaws 981, 983 provides a jaw to jaw electrical interconnection and may also provide a structural interconnection to one or both jaws. A typical jaw or jaws 981 may include but a single element, or multiple elements moving relative to the seizing conductor or moving relative to the seizing conductor link. For example, a single moving element may hold a mating conductor against a portion of the seizing conductor that operates as a stationary anvil. For example, multiple moving elements may capture a mating conductor therebetween.

FIG. 9B shows a schematic view of a single ended seizing conductor. This device includes a single jaw/jaws at one end 991 and a trailing link or terminal 992 providing an electrical interconnection means. As above, the link may also provide a structural interconnection to the jaw.

As skilled artisans will recognize, the seizing conductors of FIGS. 9A-B include an electrically conductive material. For example, jaws, links, and terminals may be made entirely of a conductive metal such as copper or a copper alloy. And, for example, these parts may be made from both electrically non-conductive and electrically conductive materials such as a plastic part covered with an electrically conductive material.

FIGS. 9C-F show a first double ended seizing conductor.

Figure 9C:
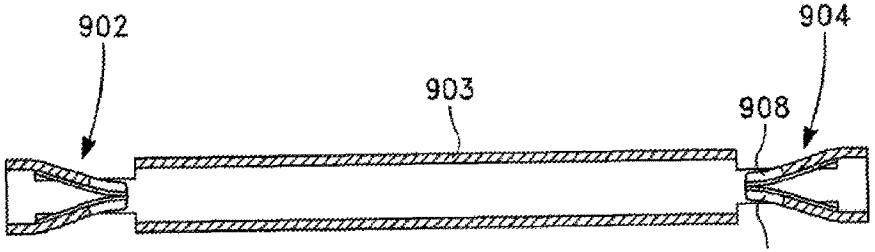

FIG. 9C shows an axial cross section of the seizing conductor. Jaws on opposed ends of the seizing connector 902, 904 are electrically interconnected by a link 903.

Figure 9E:
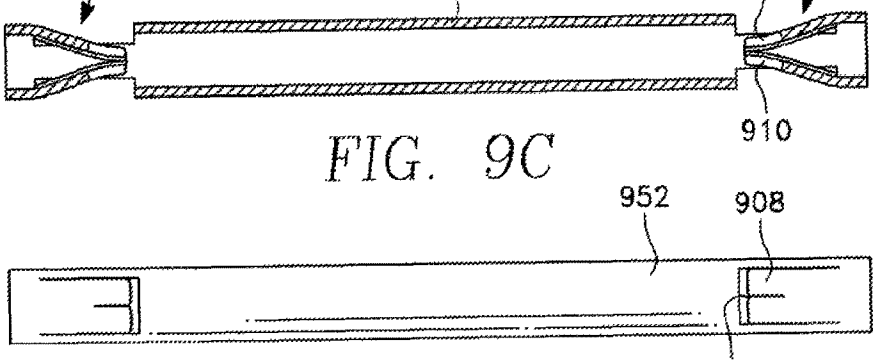
Figure 9D:
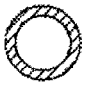

In FIG. 9D, a lateral cross-section of the link 903 shows a circular cross section.

A typical jaw includes one or more grasping elements such as tines 908, 910 that grasp or hold a mating connector's center conductor. While FIG. 9C shows both of the tines, FIG. 9E shows a second or rotated side view of the seizing conductor where only one tine 908 of the tines 908, 910 is visible.

Figure 9F:
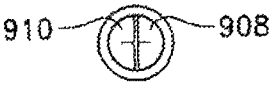

As seen, the tines are formed by partially cutting flaps or tabs from the sidewall 952 of the seizing conductor. FIG. 9F is an end view of the seizing conductor showing generally opposed tab free ends that are bent inwardly to grasp a mating connector's center conductor. In some embodiments, the tab free end includes a centrally located feature 951 such as a crease, groove, notch, indentation or the like to aid in one or both of receiving and grasping a mating center conductor. And, in some embodiments, manufacture of the seizing conductor includes use of a thin sheet of metal such as a copper alloy that is processed by punching and rolling machines to form a generally cylindrical structure.

As persons of ordinary skill in the art will recognize, in various embodiments one or more features of the seizing conductors of FIGS. 9A-F may be incorporated, or not, in the seizing conductors of FIGS. 10A-22E which follow. And, in various embodiments, one or more of the above mentioned features providing for electrical connectivity of seizing conductors may be included in any of the parts of FIGS. 10A-22E.

FIGS. 10A-F show a second double ended seizing conductor.

Figure 10B:
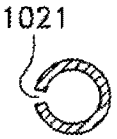
Figure 10D:
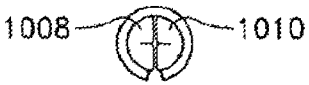
Figure 10F:
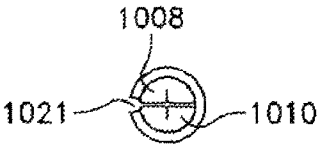
Figure 10A:
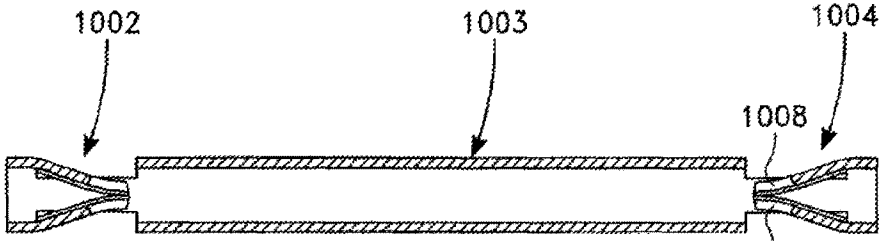

FIG. 10A shows an axial cross section of the seizing conductor. Jaws on opposed ends of the seizing connector 1002, 1004 are electrically interconnected by a link 1003.

In FIG. 10B, a lateral cross-section of the link 1003 shows an open cross section forming a semi-circular arc with a gap 1021 between ends of the arc.

A typical jaw includes one or more grasping elements that grasp or hold a mating connector's center conductor. Here, and in other embodiments, the grasping elements may be formed from separate parts or, as shown, by forming tines 1008, 1010 from flaps or tabs cut from a link sidewall 1052.

Figure 10C:
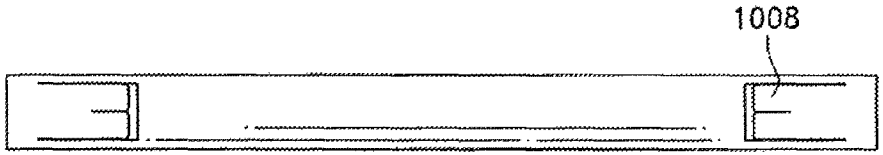

FIG. 10C shows a first rotated side view of the seizing conductor. Only one tine 1008 of the tines 1008, 1010 is visible in this view.

FIG. 10D shows an end view of the seizing conductor of FIG. 10C. In this end view, both of the tines 1008, 1010 are visible.

Figure 10E:
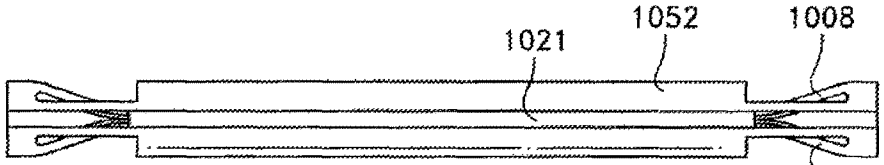

FIG. 10E shows a second rotated side view of the seizing conductor. In this view, the seizing conductor is rotated such that the gap 1021 in the seizing connector sidewall 1052 is visible.

FIG. 10F shows an end view of the seizing conductor of FIG. 10E. In this view, both of the tines 1008 and 1010 are visible.

FIGS. 10G-K show a first single ended seizing conductor.

Figure 10H:
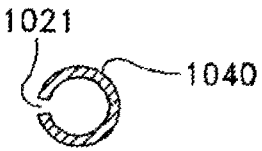
Figure 10K:
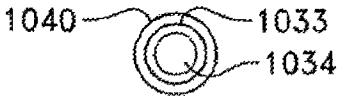
Figure 10G:
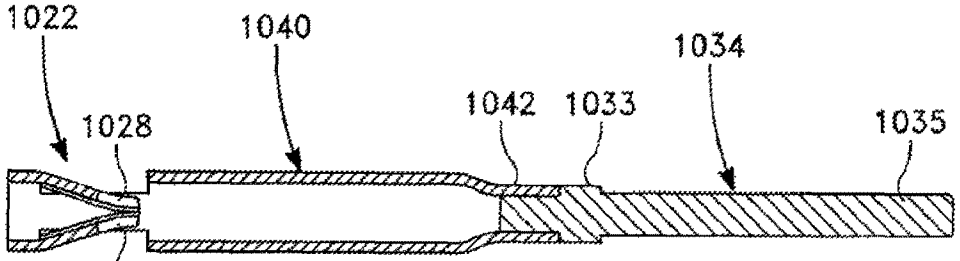

FIG. 10G shows an axial cross section of the seizing conductor. Exemplary jaws 1022 at one end of the seizing conductor include grasping elements 1028, 1030 formed in a semi-circular body 1040.

In FIG. 10H, a lateral cross-section of the semi-circular body shows an open cross section forming an arc with a gap 1021 between ends of the arc. The semi-circular body 1040 engages a terminal 1034 having a free end 1035, for example a rod or post that is solid, hollow, or a solid/hollow combination. In some embodiments, the semi-circular body has a necked down portion 1042 that engages a shouldered end 1033 of the terminal as shown.

Similar to the seizing conductor of FIG. 9B, the seizing conductor of FIG. 10G comprises jaws 1022 at one end and a link or trailing link formed by the semi-circular body 1040 and the terminal 1034.

Figure 10I:
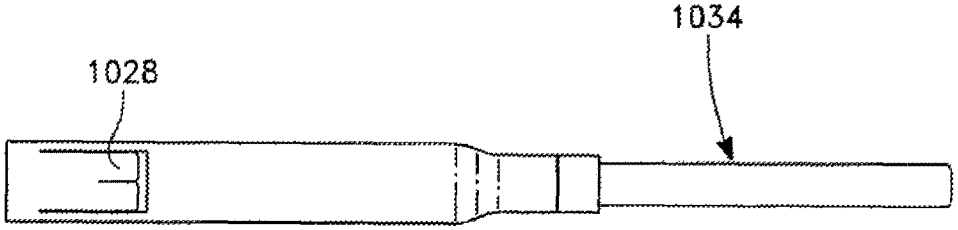

FIG. 10I is a side view of the seizing conductor. Because this view is rotated with respect to the view of FIG. 10A, only one grasping element 1028 of the two grasping elements 1028, 1030 is visible.

Figure 10J:
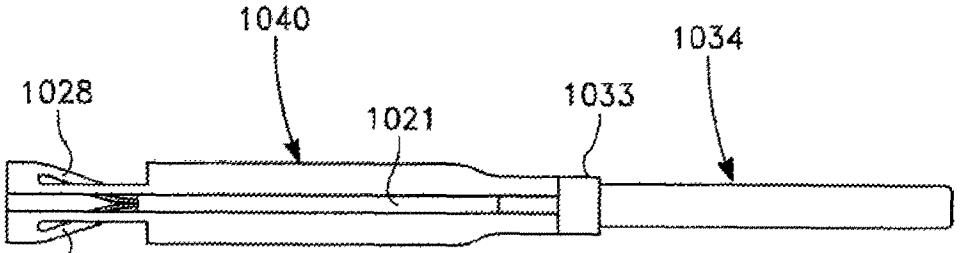

FIG. 10J shows a side view of the seizing conductor. In this side view, the seizing conductor is rotated to correspond with the axial cross section of FIG. 10A.

FIG. 10K shows an end view of the seizing conductor. Here, the end view is from the terminal end of the seizing conductor of FIG. 10J.

FIGS. 11A-F show a third double ended seizing conductor.

Figure 11A:
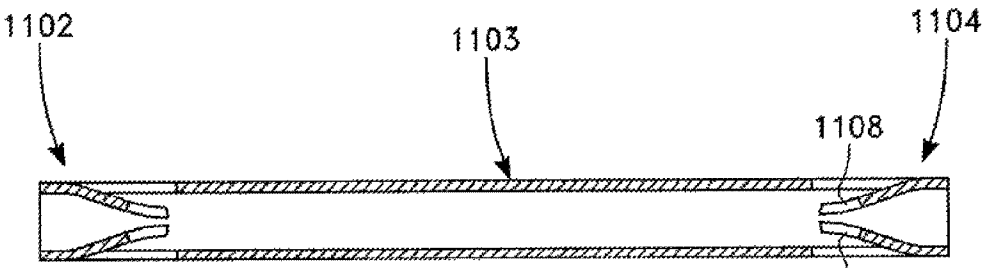

FIG. 11A shows an axial cross section of the seizing conductor. Jaws on opposed ends of the seizing connector 1102, 1104 are electrically interconnected by a link 1103.

Figure 11B:
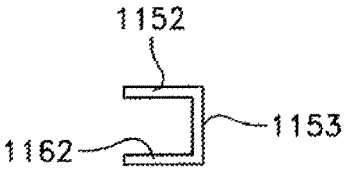

In FIG. 11B, a lateral cross-section of the link 1103 shows an open cross section forming an open polygon. As shown in the figure, the open polygon is three sides of a rectangle or parallelogram and a gap 1121.

A typical jaw includes one or more grasping elements that grasp or hold a mating connector's center conductor. Here, and in other embodiments, the grasping elements may be formed from separate parts or, as shown, by forming tines 1108, 1110 from flaps or tabs cut from opposing link sidewalls 1152, 1162 of the seizing conductor.

Figure 11C:
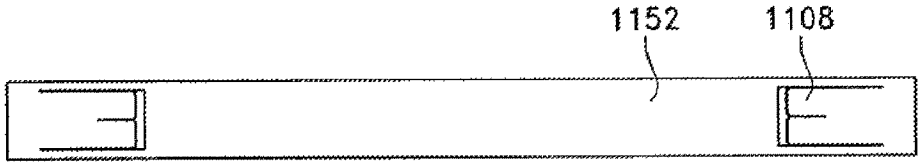

FIG. 11C shows a first rotated side view of the seizing conductor such that a link sidewall 1152 is in the foreground. Only one tine 1108 of the tines 1108, 1110 is visible in this view.

Figure 11D:
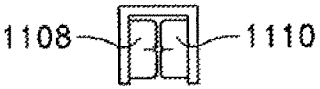

FIG. 11D shows an end view of the seizing conductor of FIG. 11C. In this end view, both of the tines 1108, 1110 are visible.

Figure 11E:
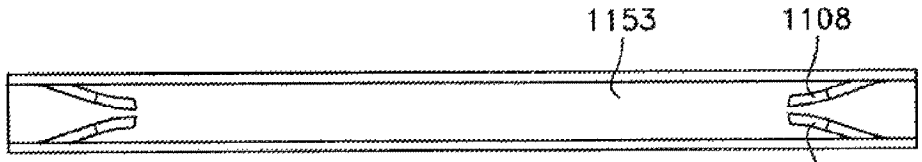

FIG. 11E shows a second rotated side view of the seizing conductor. In this view, the seizing conductor is rotated such that the link backwall 1153 is in the background.

Figure 11F:
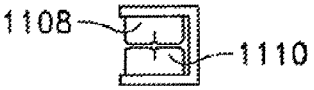

FIG. 11F shows an end view of the seizing conductor of FIG. 11E. In this end view, both of the tines 1108 and 1110 are visible.

FIGS. 11G-11K show a second single ended seizing conductor.

Figure 11H:
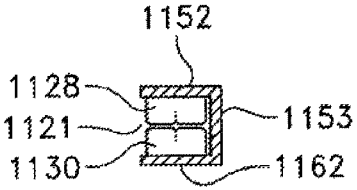
Figure 11K:
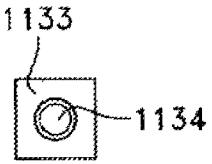
Figure 11G:
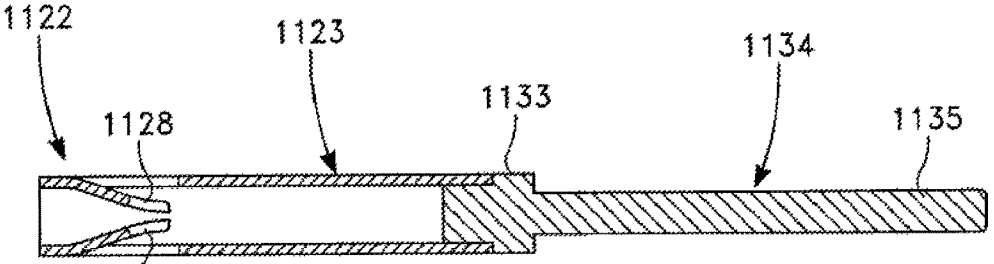

FIG. 11G shows an axial cross section of the seizing conductor. Exemplary jaws 1122 at one end of the seizing conductor include grasping elements 1128, 1130 formed in a body 1123.

In FIG. 11H, a lateral cross-section of the jaws 1122 shows an open cross section forming three sides of a polygon such as a partial rectangle with an open side or gap 1121. Grasping elements 1128 and 1130 protrude from opposed sidewalls 1152, 1162 that are joined by a backwall 1153.

The body 1123 engages a terminal 1134 having a free end 1135. In various embodiments, the terminal is a rod or post that is solid, hollow, or a solid/hollow combination. In some embodiments, the body engages a shouldered end 1133 of the terminal as shown.

Similar to the seizing conductor of FIG. 9B, the seizing conductor of FIG. 11G comprises jaws 1122 at one end adjoining a link or trailing link formed by the body 1123 and the terminal 1134.

Figure 11I:
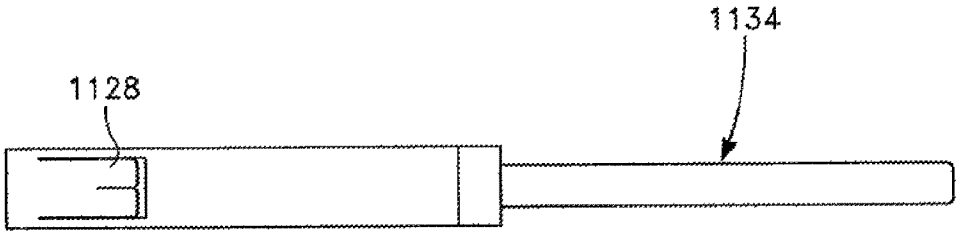

FIG. 11I is a first side view of the seizing conductor. Because this view is rotated with respect to the view of FIG. 11A, only one grasping element 1128 of the two grasping elements 1128, 1130 is visible.

Figure 11J:
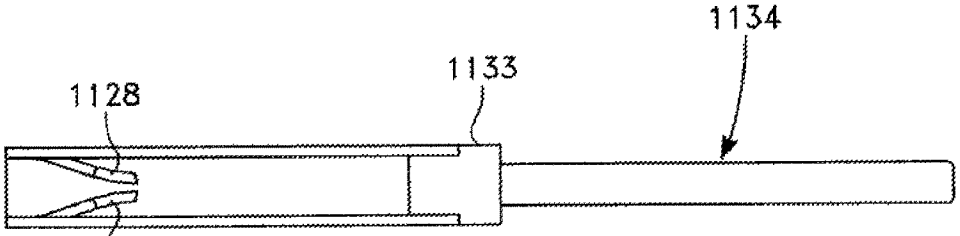

FIG. 11J shows a second side view of the seizing conductor. In this side view, the seizing conductor is rotated to correspond with the axial cross section of FIG. 11A such that the two grasping elements 1128, 1130 are visible.

FIG. 11K shows an end view of the seizing conductor. Here, the end view is from the terminal end of the seizing conductor of FIG. 11J.

Figure 12B:
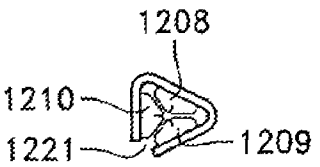
Figure 12D:
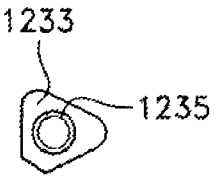
Figure 12A:
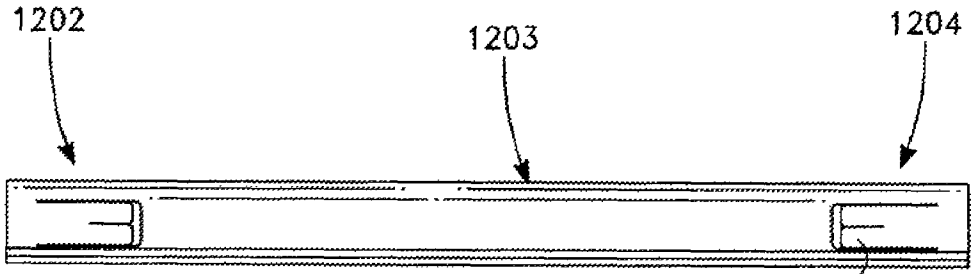

FIGS. 12A-B show a third doubled ended seizing conductor.

FIG. 12A shows a side view of the seizing conductor. Exemplary jaws 1202, 1204 at opposing ends of the conductor are interconnected by a link 1203.

FIG. 12B shows an end view of the seizing conductor of FIG. 12A. As shown, the link has an open cross section generally in the form of a triangle with a gap 1221. Formed in the sides of the triangular link are respective grasping elements 1208-1210.

Figure 12C:
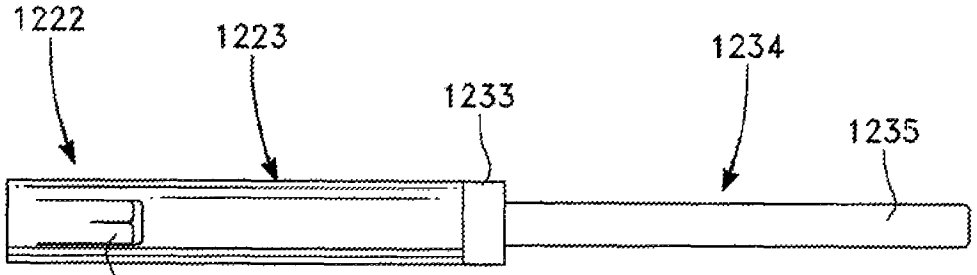

FIGS. 12C-D show a third single ended seizing conductor.

FIG. 12C shows a side view of the seizing conductor. An exemplary jaw 1222 at one end of the seizing conductor includes grasping elements 1228 such as the grasping elements of FIG. 12B formed in a body 1223.

The body 1223 engages a terminal 1234 having a free end 1235. In various embodiments, the terminal is a rod or post that is solid, hollow, or a solid/hollow combination. In some embodiments, the body engages a shouldered end 1233 of the terminal as shown.

Similar to the seizing conductor of FIG. 9B, the seizing conductor of FIG. 12C comprises jaws 1222 at one end adjoining a link or trailing link formed by the body 1223 and the terminal 1234.

FIG. 12D shows an end view of the seizing conductor. Here, the end view is from the terminal end of the seizing conductor of FIG. 12C.

Figure 13A:
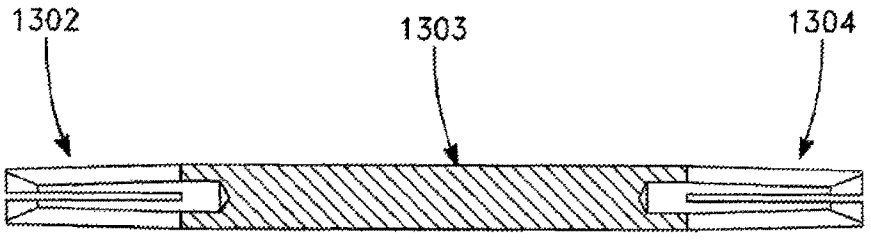
Figure 13B:
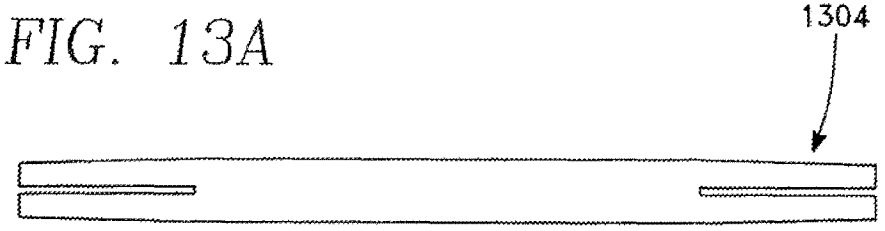
Figure 13C:
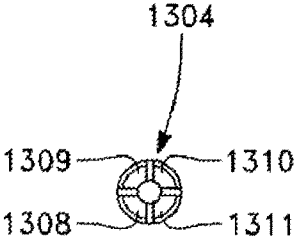

FIGS. 13A-C show a fourth double ended seizing conductor.

FIG. 13A shows an axial side view of the seizing conductor. As seen, a solid link such as a solid rod or post 1303 interconnects jaws 1302 and 1304 at its opposed ends. In various embodiments, the seizing conductor may be fabricated from a single piece and in various embodiments the seizing conductor jaws may be attachments to the link.

FIG. 13B shows a side view of the seizing conductor. This side view assumes fabrication of the seizing conductor as a single part and is rotated to correspond with the cross section of FIG. 13A.

FIG. 13C shows an end view of the seizing conductor of FIG. 13B. Here, an exemplary group of grasping elements 1308-1311 forms a jaw 1304.

Figure 13D:
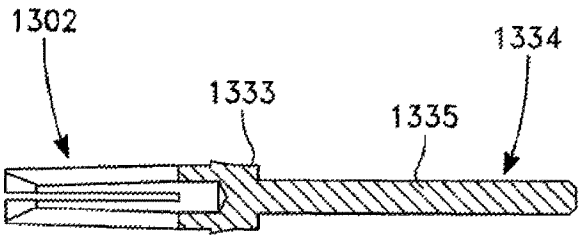
Figure 13E:
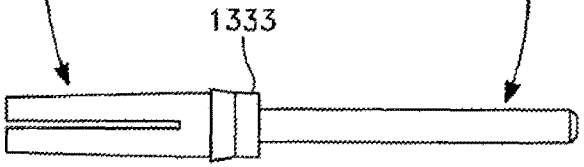
Figure 13F:
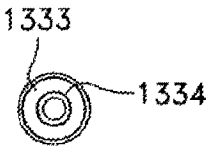

FIGS. 13D-F show a fourth single ended seizing conductor.

FIG. 13D shows an axial cross section of the seizing conductor. Exemplary jaws at one end of the seizing conductor 1302 include grasping elements similar to those of FIG. 13A.

The jaws 1302 extend from a terminal 1334 having a free end 1335. In various embodiments, the terminal is a rod or post that is solid, hollow, or a solid/hollow combination. In some embodiments, the body extends from a shouldered end 1333 of the terminal as shown.

Similar to the seizing conductor of FIG. 9B, the seizing conductor of FIG. 13D comprises jaws 1302 at one end adjoining a link or trailing link formed by the terminal 1334.

FIG. 13E shows a side view of the seizing conductor. The side view is rotated to correspond with the cross section of FIG. 13D.

FIG. 13F shows an end view of the seizing conductor. Here, the end view is from the terminal end of the seizing conductor of FIG. 13E.

FIGS. 14A-H show a fifth double ended seizing conductor.

Figure 14A:
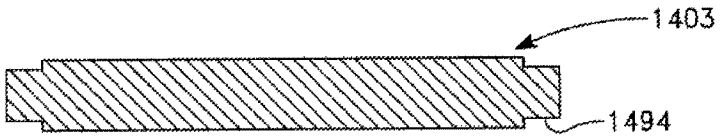

FIG. 14A shows an axial cross section of the link 1403 of the seizing conductor. As shown, the link may include end shoulders 1494 for coupling with grasping elements mentioned below.

Figure 14B:
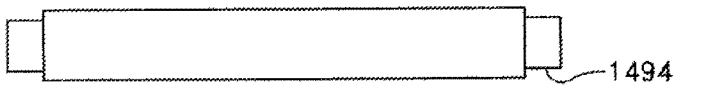
Figure 14C:
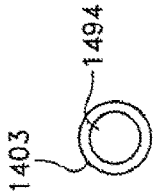

FIG. 14B shows a side view of the link of FIG. 14A and FIG. 14C shows an end view of the link.

Figure 14D:
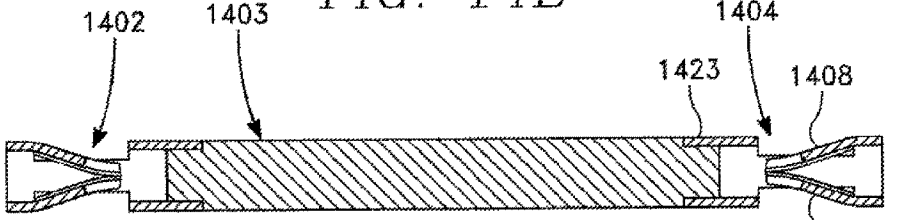

FIG. 14D shows an axial cross section of the seizing conductor. Jaws at opposed ends of the seizing connector 1402, 1404 are electrically interconnected by the link 1403. In this embodiment, a jaw 1404 with two grasping elements 1408, 1410 is formed in or near one end of a body 1423 such as a body having an open cross section. An opposing end of the body engages the link.

Figure 14E:
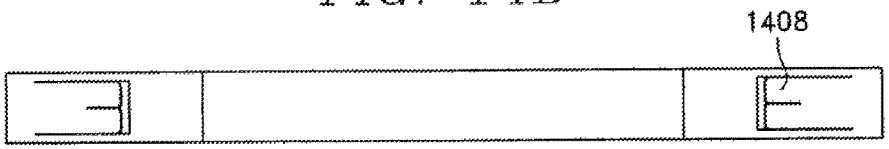

FIG. 14E shows a first side view of the seizing conductor. This view is rotated such that only a single grasping element 1408 of the two grasping elements 1408, 1410 is visible.

Figure 14F:
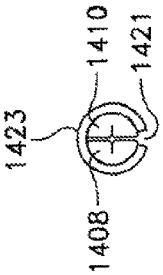

FIG. 14F shows an end view of FIG. 14E. In this view, both of the grasping elements 1408 and 1410 are visible. Also shown is a body 1423 open cross section in the form of an arc with a gap 1421 between ends of the arc.

Figure 14G:
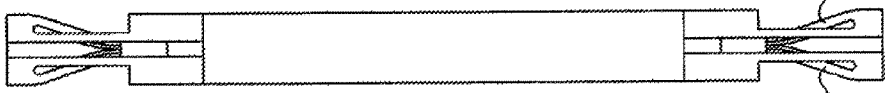

FIG. 14G shows a second side view of the seizing conductor. This view is rotated to correspond with the cross section of 14D. The grasping elements 1408, 1410 are visible in this view.

Figure 14H:
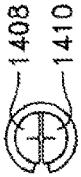

FIG. 14H shows an end view of the seizing conductor shown in FIG. 14G. The grasping elements 1408, 1410 are visible in this view.

FIGS. 15A-G show a sixth double ended seizing conductor.

Figure 15C:
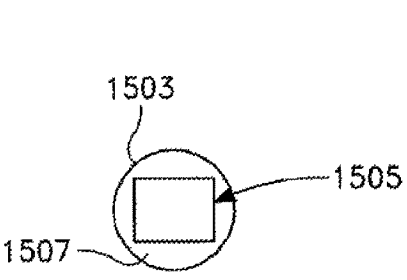
Figure 15B:
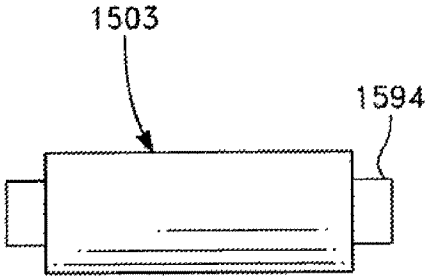
Figure 15A:
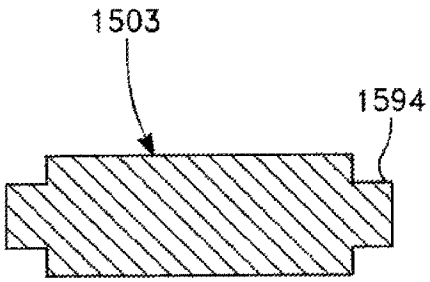

FIG. 15A shows an axial cross section of a link 1503 of the seizing conductor. As shown, the link may include end shoulder(s) 1594 for coupling with grasping elements mentioned below.

FIG. 15B shows a side view of the link of FIG. 15A and FIG. 15C shows an end view of the link. The link has a substantially cylindrical cross section 1507. In an embodiment, end shoulders define a polygonal or rectangular end of the link 1505 for fitment of grasping element(s).

Figure 15D:
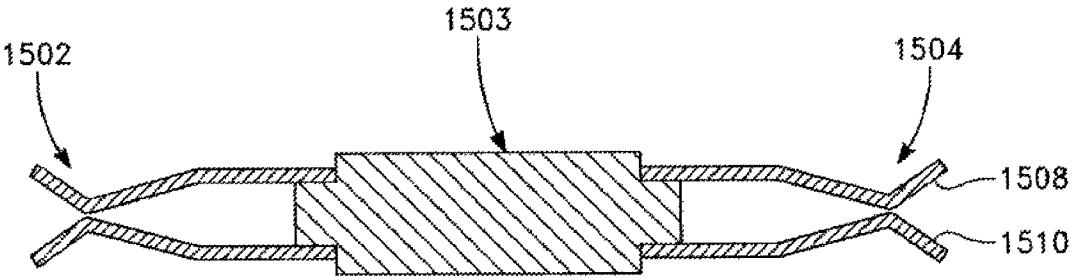

FIG. 15D shows an axial cross section of the seizing conductor. Jaws at opposed ends of the seizing connector 1502, 1504 are electrically interconnected by the link 1503. In this embodiment, a jaw 1504 is formed with two grasping elements 1508, 1510.

In this embodiment, the grasping elements 1508, 1510 may be described as a collection of canted planes that adjoin along lines such as bend lines that are substantially perpendicular to a seizing conductor longitudinal axis. For example, an elongate planar member may be marked and bent along lines perpendicular to its longitudinal axis such that a canted plane or zig-zag type structure results. The perspective view of the grasping element 1508 of FIG. 15F illustrates a suitable canted plane structure 1572-1574.

Figure 15E:
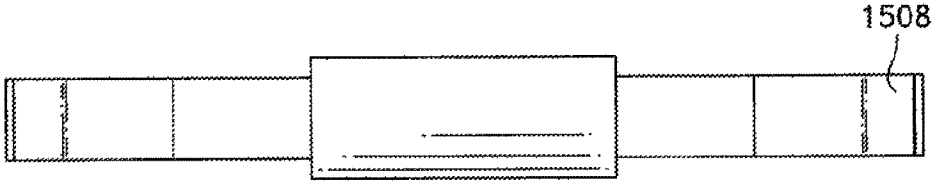

FIG. 15E shows a first side view of the seizing conductor. This view is rotated such that only one 1508 of the two grasping elements 1508, 1510 is visible.

Figure 15F:
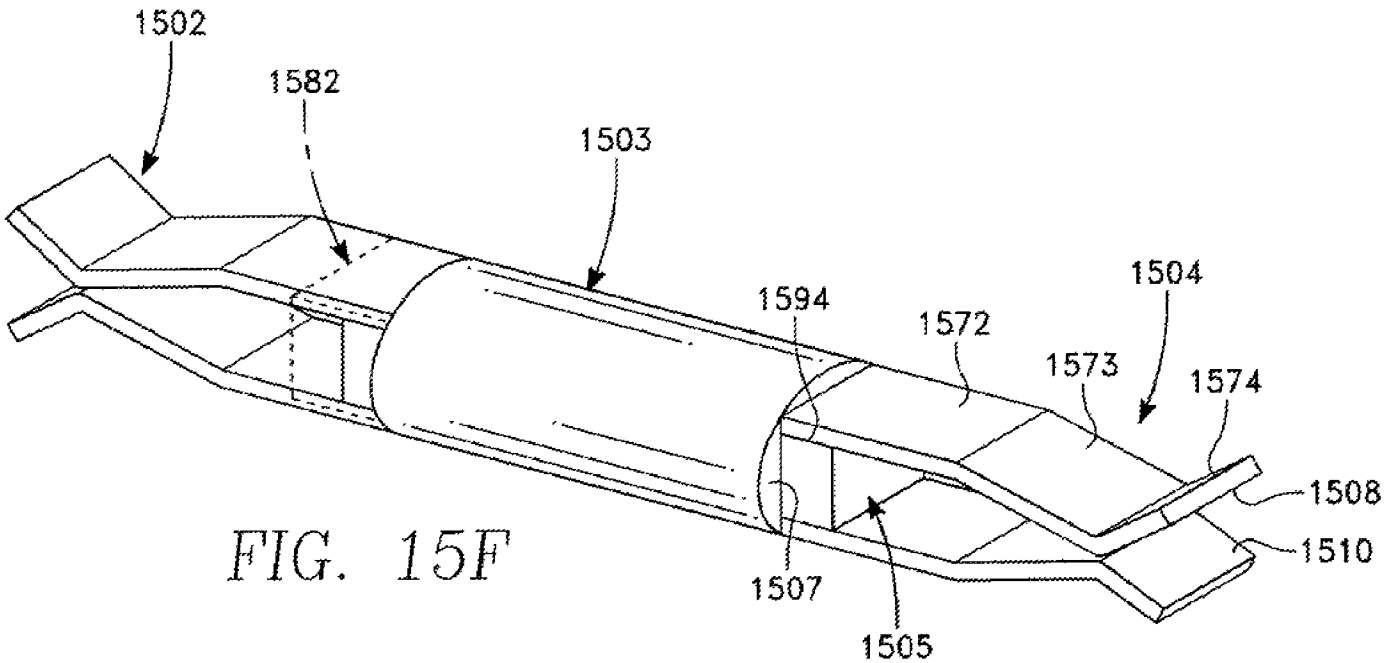

FIG. 15F shows a second side view of the seizing conductor. This view is rotated to correspond with the cross section of FIG. 15 D and both of the grasping elements 1508, 1510 are visible.

Figure 15G:
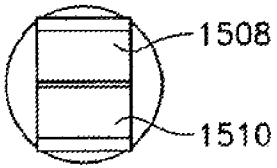

FIG. 15G shows an end view of the seizing conductor of FIG. 15F showing end views of the grasping elements 1508, 1510.

As persons of ordinary skill in the art will recognize, the seizing conductor of FIG. 15D may be cast, machined, bent, or otherwise fabricated as a joint-less part. The seizing conductor may also be assembled from multiple parts that are joined by interference fits and/or adherents such as welding, solder, and conductive adhesives. Further, grasping elements 1508, 1510 may be joined with or integral with a base 1582 that grasps the link 1503 and/or a link polygonal end such as rectangular end 1505.

FIGS. 16A-G show a seventh double ended seizing conductor.

Figure 16C:
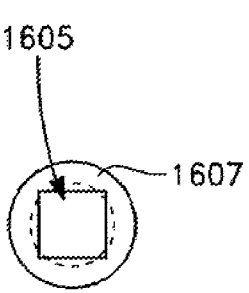
Figure 16B:
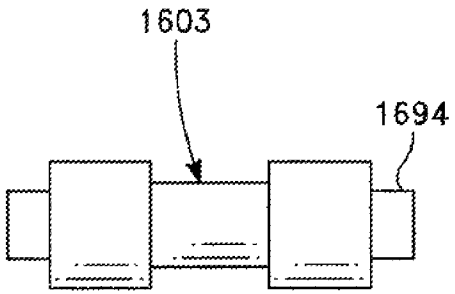
Figure 16A:
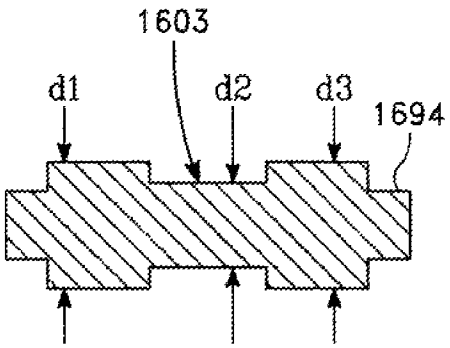

FIG. 16A shows an axial cross section of the link 1603 of the seizing conductor. As shown, the link may include end shoulder(s) 1694 for coupling with grasping elements described below.

In various embodiments, the link dimensions are selected to enhance and/or attenuate radio frequency signals in particular frequency range(s). For example a link midsection dimension or diameter d2 may be smaller than an adjacent link end-section dimension or diameter d1, d3 such that a connector body or casing surrounding the seizing conductor creates a variable dielectric gap tuned by suitable selection of variables including dimensions d1, d2, and d3.

FIG. 16B shows a side view of the link of FIG. 16A and FIG. 16C shows an end view of the link. The link includes a substantially cylindrical cross section 1607. In an embodiment, end shoulders define a polygonal or rectangular end of the link 1605 for fitment of grasping element(s).

Figure 16D:
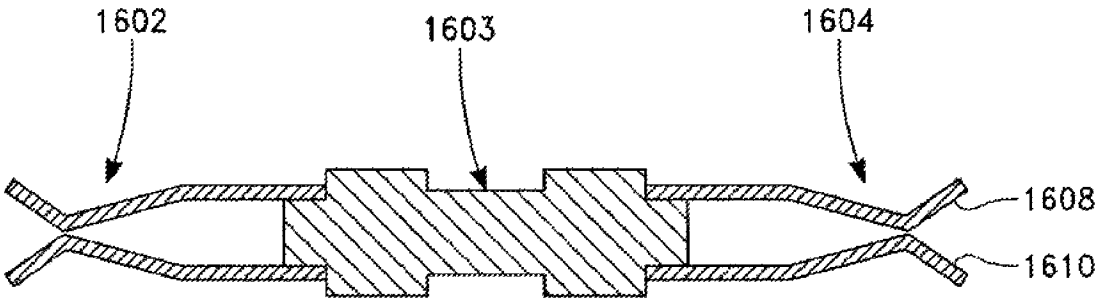

FIG. 16D shows an axial cross section of the seizing conductor. Jaws at opposed ends of the seizing connector 1602, 1604 are electrically interconnected by the link 1603. In this embodiment, a jaw 1604 is formed with two grasping elements 1608, 1610.

In an embodiment, the grasping elements 1608, 1610 may be geometrically described as a collection of canted planes that adjoin along lines such as bend lines that are substantially perpendicular to a seizing conductor longitudinal axis.

Figure 16E:
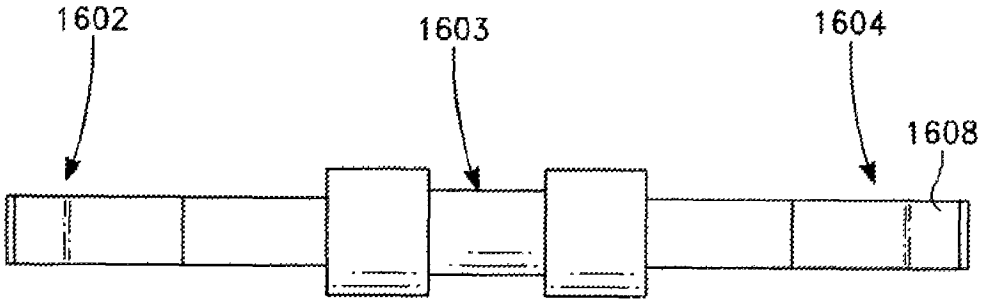

FIG. 16E shows a first side view of the seizing conductor. This view is rotated such that only one 1608 of the two grasping elements 1608, 1610 is visible.

Figure 16F:
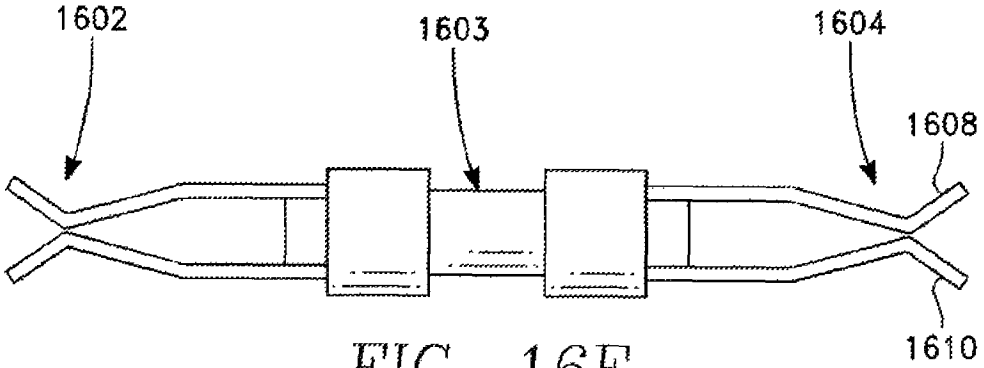

FIG. 16F shows a second side view of the seizing conductor. This view is rotated to correspond with the cross section of FIG. 16D and both of the grasping elements 1608, 1610 are visible.

Figure 16G:
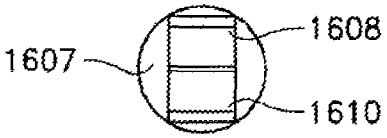

FIG. 16G shows an end view of the seizing conductor of FIG. 16F showing end views of the grasping elements 1608, 1610.

FIGS. 17A-G show an eighth double ended seizing conductor.

FIG. 17A shows an axial cross section of the link 1703 of the seizing conductor. As shown, the link may include end shoulder(s) 1794 for coupling with grasping elements mentioned below.

FIG. 17B shows a side view of the link of FIG. 17A and FIG. 17C shows an end view of the link. The link has a substantially rectangular cross section 1707. In an embodiment, end shoulders define a polygonal or rectangular end of the link 1705 for fitment of grasping element(s).

FIG. 17D shows an axial cross section of the seizing conductor. Jaws at opposed ends of the seizing connector 1702, 1704 are electrically interconnected by the link 1703. In this embodiment, a jaw 1704 is formed with two grasping elements 1708, 1710.

In an embodiment, the grasping elements 1708, 1710 may be geometrically described as a collection of canted planes that adjoin along lines such as bend lines that are substantially perpendicular to a seizing conductor longitudinal axis.

FIG. 17E shows a first side view of the seizing conductor. This view is rotated such that only one 1708 of the two grasping elements 1708, 1710 is visible.

FIG. 17F shows a second side view of the seizing conductor. This view is rotated to correspond with the cross section of FIG. 17D and both of the grasping elements 1708, 1710 are visible.

FIG. 17G shows an end view of the seizing conductor of FIG. 17F showing end views of the grasping elements 1708, 1710.

Figure 18A:
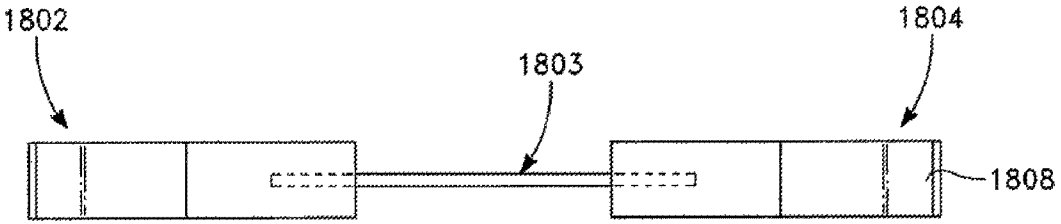
Figure 18B:
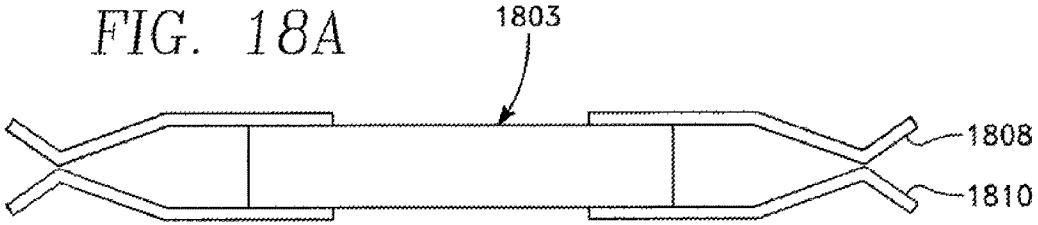
Figure 18C:
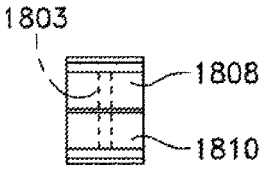

FIGS. 18A-C show a ninth double ended seizing conductor.

FIG. 18A shows a first side view of the seizing conductor. Jaws at opposed ends of the seizing connector 1802, 1804 are electrically interconnected by a link 1803. In this embodiment, a jaw 1804 is formed with two grasping elements 1808, 1810 (See also FIG. 18B).

The link 1803 consists of an elongated flat plate with opposed ends. As shown in FIGS. 18A-B, two grasping elements 1808, 1810 protrude from each end of the plate.

FIG. 18B shows a second side view of the seizing conductor that is rotated such that both of the grasping elements 1808, 1810 are visible. In an embodiment, the grasping elements 1808, 1810 may be geometrically described as a collection of canted planes that adjoin along lines such as bend lines that are substantially perpendicular to a seizing conductor longitudinal axis.

FIG. 18C shows an end view of the seizing conductor of FIG. 18B. In this view the link 1803 is shown behind the grasping elements 1808, 1810.

The seizing conductor of FIGS. 18A-C may be made from multiple parts. For example, the link 1803 and each of the grasping elements 1808, 1810 may be separate parts that are joined by any suitable adherent or adherent method known to skilled artisans. In other embodiments, jaws 1802, 1804 may be a single part such as a part cut, folded and/or bent from suitable sheet stock.

Figure 18D:
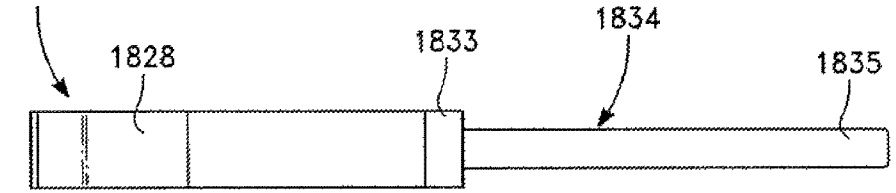
Figure 18E:
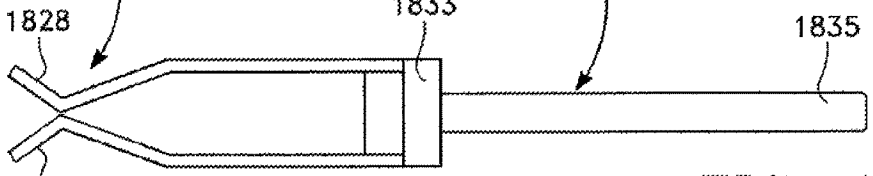
Figure 18F:
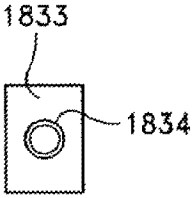

FIGS. 18D-F show a seventh single ended seizing conductor.

FIG. 18D shows a first side view of the seizing conductor. Exemplary jaws at one end of the seizing conductor 1802 include grasping elements 1828, 1830 similar to those of FIG. 18A (See also FIG. 18E).

The jaws 1822 extend from a terminal 1834 having a free end 1835. In various embodiments, the terminal is a rod or post that is solid, hollow, or a solid/hollow combination. In some embodiments, the body extends from a shouldered end 1833 of the terminal as shown.

Similar to the seizing conductor of FIG. 9B, the seizing conductor of FIG. 18D comprises jaws 1822 at one end adjoining a link or trailing link formed by the terminal 1834.

FIG. 18E shows a second side view of the seizing conductor. The side view is rotated such that both of the grasping elements 1828, 1830 are visible. In an embodiment, the grasping elements may be geometrically described as a collection of canted planes that adjoin along lines such as bend lines that are substantially perpendicular to a seizing conductor longitudinal axis.

FIG. 18F shows an end view of the seizing conductor. Here, the end view is from the terminal end of the seizing conductor of FIG. 18E.

Figure 19A:
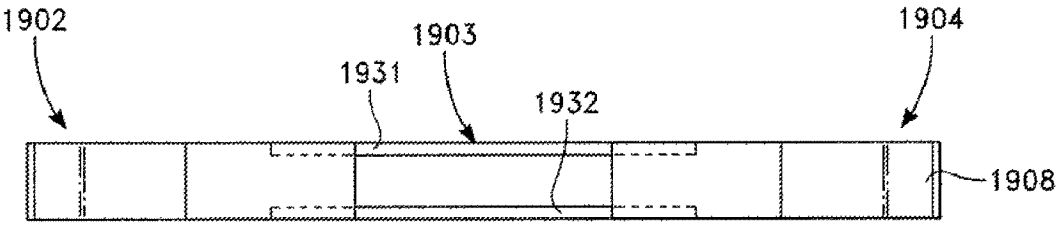
Figure 19B:
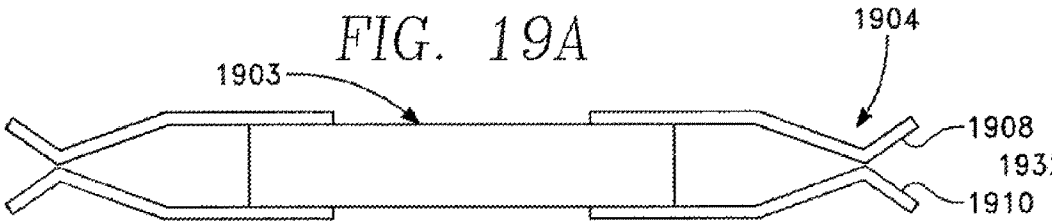
Figure 19C:
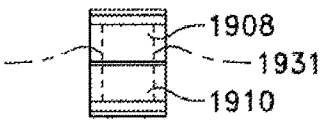

FIGS. 19A-C show a ninth double ended seizing conductor.

FIG. 19A shows a first side view of the seizing conductor. Jaws at opposed ends of the seizing connector 1902, 1904 are electrically interconnected by a link 1903. In this embodiment, a jaw 1904 is formed with two grasping elements 1908, 1910 (See also FIG. 19B).

The link 1903 consists of two elongated flat plates 1931, 1932 that are spaced apart in parallel relationship. As shown in FIGS. 19A-B, two grasping elements 1908, 1910 protrude from each end of the link.

FIG. 19B shows a second side view of the seizing conductor that is rotated such that the two grasping elements 1908, 1910 are visible but only one of the link plates 1932 is visible. In an embodiment, the grasping elements 1908, 1910 may be geometrically described as a collection of canted planes that adjoin along lines such as bend lines that are substantially perpendicular to a seizing conductor longitudinal axis.

FIG. 19C shows an end view of the seizing conductor of FIG. 19B. In this view the link plates 1931, 1932 are shown behind the grasping elements 1908, 1910.

The seizing conductor of FIGS. 19A-C may be made from multiple parts. For example, the link 1903 and each of the grasping elements 1908, 1910 may be separate parts that are joined by any suitable adherent or adherent method known to skilled artisans. In other embodiments, jaws 1902, 1904 may be a single part such as a part cut, folded and/or bent from suitable sheet stock.

Further, the seizing conductor of FIGS. 19A-C may comprise a single part, for example the seizing conductor may be cut from sheet stock such as plate or rolled stock and manipulated by processes including one or more of pressing, bending, folding, and adhering to form the desired part.

Figure 19D:
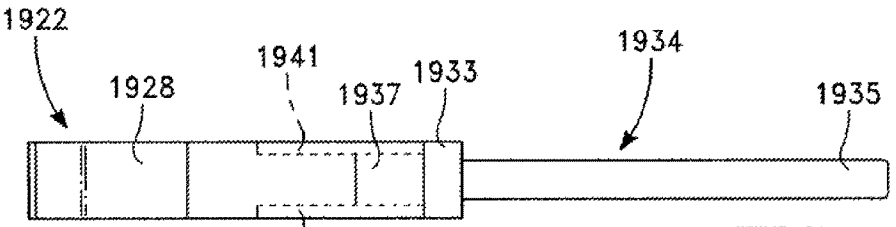
Figure 19E:
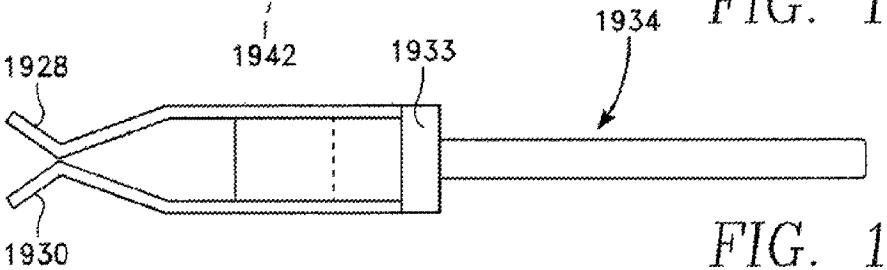
Figure 19F:
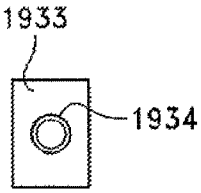

FIGS. 19D-F show an eighth single ended seizing conductor.

FIG. 19D shows a first side view of the seizing conductor. Exemplary jaws at one end of the seizing conductor 1902 include grasping elements 1908, 1910 (see also FIG. 19E). In an embodiment, the grasping elements 1908, 1910 are separated at one end by parallel edge plates 1941, 1942 which may or may not be integral with one or both of the grasping elements.

The jaws 1902 extend from a terminal 1934 having a free end 1935. In various embodiments, the terminal is a rod or post that is solid, hollow, or a solid/hollow combination. In some embodiments, the body extends from a shouldered end 1933 of the terminal as shown. As shown, a terminal stub 1937 may provide for attaching the jaws 1902 by an adherent or a fit such as an interference fit with the edge plates 1941, 1942 and/or the grasping element 1908, 1910 ends adjacent to the edge plates.

Similar to the seizing conductor of FIG. 9B, the seizing conductor of FIG. 19D comprises jaws 1922 at one end adjoining a link or trailing link formed by the terminal 1934.

FIG. 19E shows a second side view of the seizing conductor. The side view is rotated such that both of the grasping elements 1928, 1930 are visible. In an embodiment, the grasping elements may be geometrically described as a collection of canted planes that adjoin along lines such as bend lines that are substantially perpendicular to a seizing conductor longitudinal axis.

FIG. 19F shows an end view of the seizing conductor. Here, the end view is from the terminal end of the seizing conductor of FIG. 19E.

FIGS. 20A-D show a tenth double ended seizing conductor.

Figure 20A:
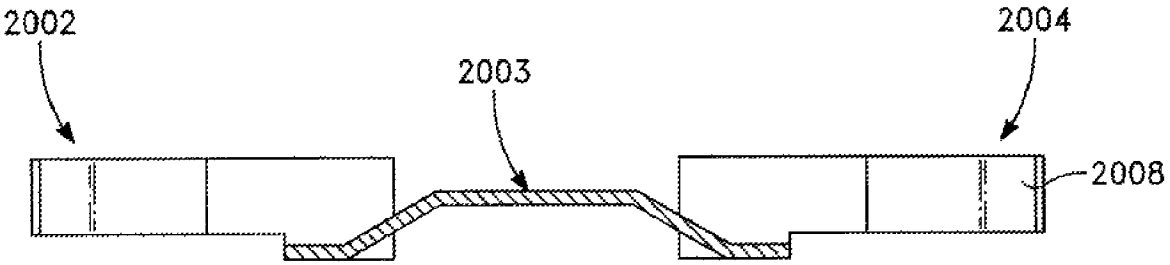

FIG. 20A shows an axial cross section of the seizing conductor. Jaws at opposed ends of the seizing connector 2002, 2004 are electrically interconnected by a link 2003. In this embodiment, a jaw is formed with two grasping elements 2008, 2010 (See also FIG. 20C).

Figure 20B:
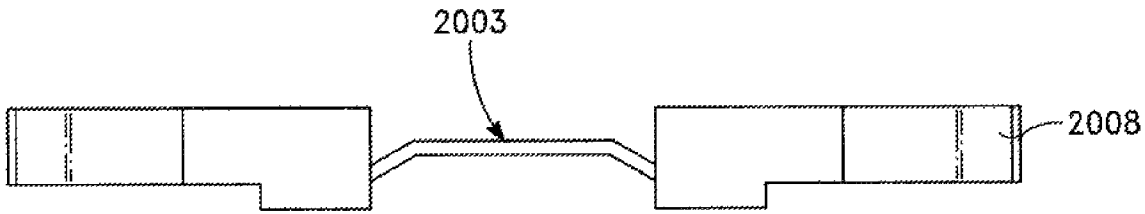

In an embodiment, the link 2003 is a bent plate that is integral with or adhered the jaws 2002, 2004. As shown in FIGS. 20A-B, two grasping elements such as grasping elements 2008, 2010 protrude near each end of the link.

FIG. 20B shows a first side view of the seizing conductor that is rotated to correspond with the cross section of FIG. 20A.

Figure 20C:
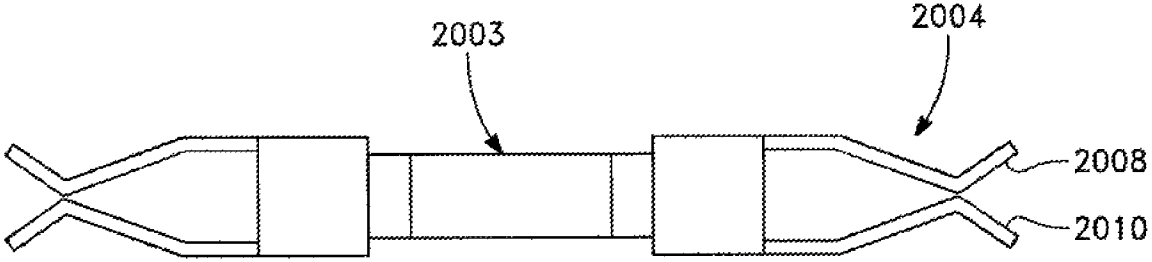

FIG. 20C shows a second side view of the seizing conductor that is rotated such that the two grasping elements 2008, 2010 are visible. In an embodiment, the grasping elements 2008, 2010 may be geometrically described as a collection of canted planes that adjoin along lines such as bend lines that are substantially perpendicular to a seizing conductor longitudinal axis. And, in an embodiment the link 2003 may be described as having similar geometry.

Figure 20D:
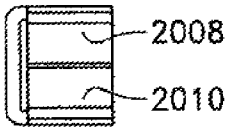

FIG. 20D shows an end view of the seizing conductor of FIG. 20C. Here, an end view of the grasping elements 2008, 2010 are visible.

The seizing conductor of FIGS. 20A-C may be made from multiple parts. For example, the link 2003 and each of the grasping elements 2008, 2010 may be separate parts that are joined by any suitable adherent or adherent method known to skilled artisans. In other embodiments, jaws 2002, 2004 may be a single part such as a part cut, folded and/or bent from suitable sheet stock.

Further, the seizing conductor of FIGS. 20A-C may comprise a single part, for example the seizing conductor may be cut from sheet stock or rolled stock and manipulated by processes including one or more of pressing, bending, folding, and adhering to form the desired part.

Figure 21A:
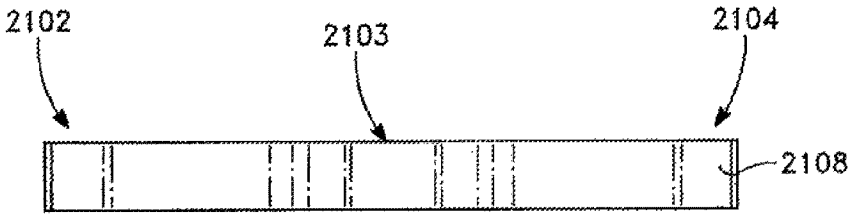
Figure 21B:
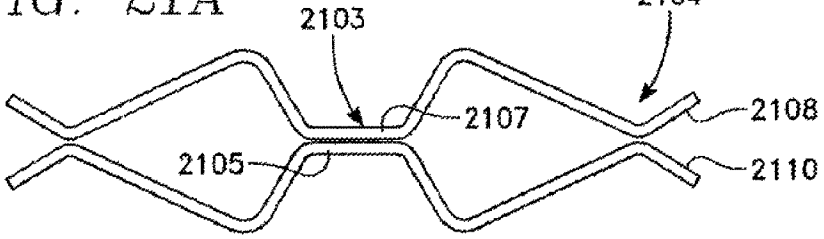
Figure 21C:
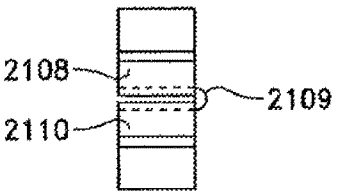

FIGS. 21A-C show an eleventh double ended seizing conductor.

FIG. 21A shows a first side view of the seizing conductor. Jaws at opposed ends of the seizing connector 2102, 2104 (See also FIG. 21B) are electrically interconnected by a link 2103. In this embodiment, a jaw is formed with two grasping elements 2108, 2110.

FIG. 21B shows a second side view of the seizing conductor. This view is rotated such that the grasping elements 2108, 2110 are visible.

FIG. 21C shows an end view of FIG. 21B. Here, the ends of the grasping elements 2108, 2110 are visible. In an embodiment, a folding connector 2109 provides for making the seizing connector as a single part. For example, FIG. 21C shows an optional foldable web 2109 of the link 2103 that joins link segments 2105, 2107 that adjoin grasping elements. In an exemplary fabrication sequence, a flat plate is cut forming a one piece planar version of the seizing conductor that is shaped, adhered, and/or finished by machinery to form the seizing conductor.

In an embodiment, the grasping elements 2108, 2110 may be geometrically described as a collection of canted planes that adjoin along lines such as bend lines that are substantially perpendicular to a seizing conductor longitudinal axis.

Figure 21D:
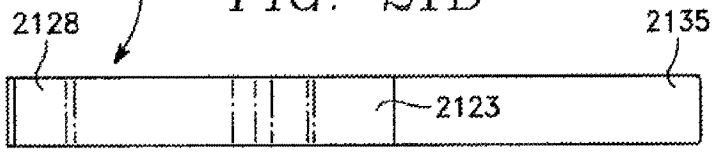
Figure 21E:
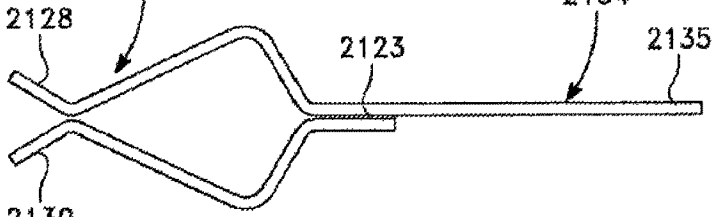
Figure 21F:
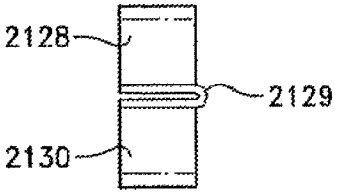

FIGS. 21D-F show a ninth single ended seizing conductor.

FIG. 21D shows a first side view of the seizing conductor. Exemplary jaws (See also FIG. 21E) at one end of the seizing conductor 2122 include grasping elements 2128, 2130 similar to those of FIG. 21A.

FIG. 21E shows a second side view of the seizing conductor. Here, the view is rotated such that the grasping elements 2128, 2130 are visible.

The jaws 2102 extend from a terminal 2134 having a free end 2135. In an embodiment, the terminal is integral with but one 2128 of the two grasping elements 2128, 2130.

Similar to the seizing conductor of FIG. 9B, the seizing conductor of FIG. 21D comprises jaws 2122 at one end adjoining a link or trailing link formed by the terminal 2134.

FIG. 21F shows a terminal end view of the seizing conductor of FIG. 21D. Here, ends of the grasping elements 2108, 2110 are visible. In an embodiment, a folding part provides for making the seizing connector as a single part. For example, FIG. 21F shows an optional foldable web 2129 of the terminal 2134 and first grasping element 2128 that joins with the second grasping element 2130. In an exemplary fabrication sequence, stock such as sheet stock or rolled stock is cut forming a one piece version of the seizing conductor that is shaped, adhered, and or finished by machinery to form the seizing conductor including folding of the web 2123.

Figure 22A:
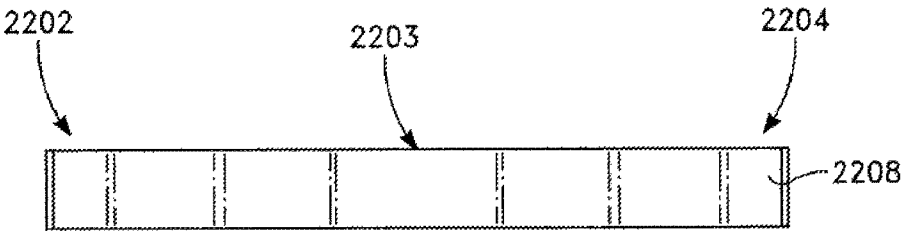
Figure 22B:
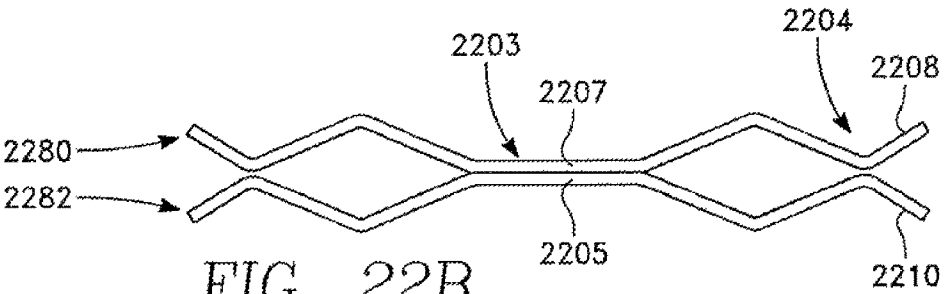
Figure 22C:
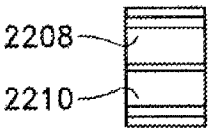

FIGS. 22A-C show a twelfth double ended seizing conductor.

FIG. 22A shows a first side view of the seizing conductor. Jaws at opposed ends of the seizing connector 2202, 2204 (See also FIG. 22B) are electrically interconnected by a link 2203. In this embodiment, a jaw is formed with two grasping elements 2208, 2210.

FIG. 22B shows a second side view of the seizing conductor. This view is rotated such that the grasping elements 2208, 2210 are visible.

FIG. 22C shows an end view of FIG. 22B. Here, the ends of the grasping elements 2208, 2210 are visible.

In the embodiment shown, the seizing conductor is made from two parts, an upper part 2280 and a lower part 2282. The upper part includes an upper link segment 2207 that joins upper left and upper right grasping elements such as grasping element 2208. The lower part includes a lower link segment 2205 that joins lower left and lower right grasping elements such as grasping element 2210.

In various embodiments, each of the seizing conductor upper and lower parts 2280, 2282 may be geometrically described as a collection of canted planes that adjoin along lines such as bend lines that are substantially perpendicular to a seizing conductor longitudinal axis.

Figure 22D:
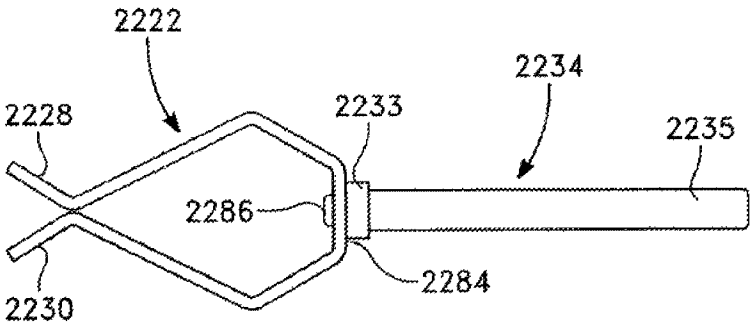
Figure 22E:
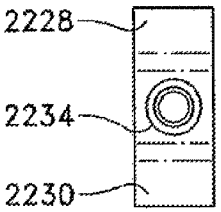

FIGS. 22D-E show a tenth single ended seizing conductor.

FIG. 22D shows a first side view of the seizing conductor. Exemplary jaws at one end of the seizing conductor 2222 include grasping elements 2228, 2230 similar to those of FIG. 22A.

As shown, the jaw or jaws 2222 include grasping elements 2228, 2230 and are formed as a single part. Extending from the jaws is a terminal 2234 having a free end 2235. In an embodiment, the terminal includes a shoulder 2233 near a jaw/terminal attachment point 2284. In various embodiments, the jaw is adhered to the terminal. In the embodiment shown, a fastening means or fastener such as a dowel 2286 secures the jaw 2222 to the terminal 2234.

FIG. 22E shows a terminal end view of the seizing conductor of FIG. 22D. Here, ends of the grasping elements 2228, 2230 are visible.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A coaxial connector comprising:

a connector body having a longitudinal axis passing through first and second opposed body ends, the second body end for engaging a male coaxial cable connector;

a connector center conductor for transporting a signal through the connector;

a second body end insulator supports the connector center conductor;

a single coil spring that is coiled about the longitudinal axis and the second body end insulator;

one end of the coil spring immovable with respect to the body; and, the coil spring urging an electromagnetic shield to protrude from the second body end.

2. The coaxial connector of claim 1 wherein the connector center conductor is non-tubular.

3. The coaxial connector of claim 2 wherein the spring is proximate the second body end.

4. The coaxial connector of claim 2 further comprising:

a connector center conductor insulator proximate the second body end; and, wherein the connector center conductor and the insulator are stationary with respect to the connector body.

5. The connector of claim 1 wherein the center conductor is a fixed length center conductor.

6. The connector of claim 5 wherein the center conductor is within and does not extend beyond the connector body.

7. The connector of claim 5 further comprising:

a first insulator between the connector center conductor and the connector body; and, wherein the insulator slidingly engages the center conductor.

8. The connector of claim 7 further comprising:

a second insulator between the center conductor and the connector body;

the second insulator spaced apart from the first insulator; and, a distance between the first and second insulators being reduced when the male coaxial cable engages the connector body.

9. The coaxial connector of claim 1 wherein the connector center conductor has a portion between the center conductor ends that is tubular and a portion between the center conductor ends that is non-tubular.

10. The coaxial connector of claim 1 wherein the connector center conductor includes a conductor receiver with one end for receiving a removable conductor and an opposite end for receiving a bar.

11. The connector of claim 10 wherein the connector receiver includes opposed grasping elements in the form of canted planes adjoined along bend lines that are substantially perpendicular to a seizing conductor longitudinal axis.

12. The connector of claim 1 wherein the connector center conductor is made from a flat plate having an irregular outline, the flat plate having opposing ends that are folded to create receivers for removable conductors and a section joining the receivers that is not folded.

13. The connector of claim 1 wherein the connector center conductor is made from opposed flat plates of rectangular cross section, the plates in the form of canted planes and joined at a plate center such that at opposed extremities pockets are created for receiving removable center conductors.

* * * * *